US010001335B2

(12) United States Patent
Patterson et al.

(10) Patent No.: US 10,001,335 B2
(45) Date of Patent: Jun. 19, 2018

(54) TRIGGER ASSEMBLY OF A PRECISION GUIDED FIREARM

(71) Applicant: TrackingPoint, Inc., Pflugerville, TX (US)

(72) Inventors: Roy Patterson, Taylor, TX (US); Mark Delz, Round Rock, TX (US); Ehren Achee, Georgetown, TX (US); Kevin D Brase, Leander, TX (US); Hillman Bailey, Dripping Springs, TX (US); Jason Peter Schauble, Austin, TX (US)

(73) Assignee: TrackingPoint, Inc., Pflugerville, TX (US)

( * ) Notice: Subject to any disclaimer, the term of this patent is extended or adjusted under 35 U.S.C. 154(b) by 0 days. days.

(21) Appl. No.: 14/815,931

(22) Filed: Jul. 31, 2015

(65) Prior Publication Data

US 2016/0061549 A1 Mar. 3, 2016

Related U.S. Application Data

(60) Provisional application No. 62/031,952, filed on Aug. 1, 2014.

(51) Int. Cl.

| | |
|---|---|
| ***F41A 17/00*** | (2006.01) |
| ***F41A 19/14*** | (2006.01) |
| ***F41A 17/56*** | (2006.01) |
| ***F41A 19/12*** | (2006.01) |
| ***F41A 19/58*** | (2006.01) |
| ***F41G 1/38*** | (2006.01) |
| ***F41G 1/00*** | (2006.01) |

(52) U.S. Cl.

CPC ..... *F41A 19/14* (2013.01); *F41A 17/56* (2013.01); *F41A 19/12* (2013.01); *F41A 19/58* (2013.01); *F41G 1/00* (2013.01); *F41G 1/38* (2013.01)

(58) Field of Classification Search

CPC ..... F41A 17/06; F41A 17/063; F41A 17/066; F41A 17/08; F41A 19/58

USPC ..... 42/70.01, 70.06, 70.08, 70.11, 84

See application file for complete search history.

(56) References Cited

U.S. PATENT DOCUMENTS

| | | | | |
|---|---|---|---|---|
| 3,703,845 | A * | 11/1972 | Griew | F41G 3/26 273/405 |
| 4,031,648 | A | 6/1977 | Thomas | |
| 4,428,138 | A | 1/1984 | Seecamp | |
| 4,476,644 | A | 10/1984 | Laing | |
| 4,730,407 | A | 3/1988 | De Carlo | |
| 5,192,818 | A * | 3/1993 | Martin | F41A 17/06 42/70.01 |
| 5,581,898 | A | 12/1996 | Thummel | |

(Continued)

FOREIGN PATENT DOCUMENTS

| | | |
|---|---|---|
| WO | 2005116567 | 12/2005 |

OTHER PUBLICATIONS

PCT/US15/43227, Search Report and Written Opinion, dated Apr. 19, 2016, 11 pages.

*Primary Examiner* — Michael David

(74) *Attorney, Agent, or Firm* — Cesari & Reed LLP; R. Michael Reed

(57) ABSTRACT

In certain embodiments, a trigger assembly including a bi-stable switch system configured to selectively engage a portion of the sear in a first state and to transition from the first state to a second state to selectively disengage the portion of the sear in response to an electrical signal.

15 Claims, 18 Drawing Sheets

(56) References Cited

U.S. PATENT DOCUMENTS 5,655,066 A 8/1997 Martin et al.
5,850,170 A 12/1998 Kern
5,915,936 A 6/1999 Brentzel
5,937,557 A * 8/1999 Bowker ..... F41A 17/066 102/472
5,966,859 A * 10/1999 Samuels ..... F41A 17/066 42/70.11
6,185,852 B1 * 2/2001 Whalen ..... F41A 17/066 42/70.11
6,237,271 B1 * 5/2001 Kaminski ..... F41A 17/063 42/70.01
6,442,880 B1 9/2002 Allan
6,499,243 B1 * 12/2002 Herzog ..... F41A 17/066 42/70.06
6,539,658 B1 * 4/2003 Hubert ..... F41A 17/74 42/70.08
6,563,940 B2 * 5/2003 Recce ..... B60R 25/04 382/120
6,785,996 B2 * 9/2004 Danner ..... F41A 17/08 42/70.01
6,823,621 B2 * 11/2004 Gotfried ..... F41A 17/066 42/70.01
6,843,014 B1 * 1/2005 Aponte ..... F41A 17/06 42/70.06
6,856,238 B2 * 2/2005 Wootton ..... F41A 17/063 340/10.1
7,030,729 B2 * 4/2006 Albanesi ..... F41A 17/063 340/10.1
7,441,362 B1 * 10/2008 Kley ..... F41A 17/066 42/1.09
7,661,218 B2 2/2010 Pikielny
7,806,039 B1 10/2010 Gomez
8,650,789 B2 2/2014 Dionne et al.
8,650,790 B2 2/2014 Dionne et al.
8,726,555 B2 5/2014 Carr
8,807,007 B2 8/2014 Alicea
2001/0042332 A1 11/2001 Gering et al.
2003/0097776 A1 * 5/2003 Brosow ..... F41A 17/063 42/70.01
2006/0242879 A1 11/2006 Schmitter
2007/0137470 A1 6/2007 Oertwig
2008/0302235 A1 12/2008 Lauck
2009/0007476 A1 * 1/2009 Mauch ..... F41A 17/063 42/1.01
2010/0170131 A1 * 7/2010 Zukowski ..... F41A 17/66 42/70.08
2012/0180357 A1 7/2012 Dietel et al.
2013/0167423 A1 7/2013 Lupher et al.
2014/0196341 A1 7/2014 Tasyagan
2015/0253095 A1 * 9/2015 Wilson ..... F41A 19/14 42/69.01
2016/0018176 A1 * 1/2016 Fellows ..... F41A 19/02 42/69.03
2016/0131449 A1 * 5/2016 Horch ..... F41A 19/16 42/69.01

* cited by examiner

BLOCKED, TRIGGER NOT PULLED, SAFETY ON

WAITING FOR SCOPE TO RELEASE SHOT: TRIGGER PULLED, BLOCKED, SAFETY OFF

HAMMER RELEASED (JUST UNBLOCKED): SAFETY OFF, TRIGGER PULLED,

IMEDIATELY AFTER EJECT AND LOAD: TRIGGER PULLED, DISCONNECT CONTROLS HAMMER

ADITIONAL MODE: UNBLOCKED, TRIGGER NOT PULLED, SAFETY OFF

TRIGGER ASSEMBLY OF A PRECISION GUIDED FIREARM

CROSS-REFERENCE TO RELATED APPLICATION(S)

The present disclosure is a non-provisional of and claims priority to U.S. Provisional Patent Application No. 62/031,952 filed on Aug. 1, 2014 and entitled "Trigger Assembly of a Precision Guided Firearm," which is incorporated herein by reference in its entirety.

FIELD

The present disclosure is generally related to trigger assemblies, and more particularly, to trigger assemblies for use in circuit controllable firearms.

BACKGROUND

A firearm typically includes a trigger assembly including a trigger shoe that is accessible by a shooter to discharge the firearm. The trigger assembly may include a sear configured to secure a hammer of the firearm until the trigger is pulled. Additionally, the trigger assembly may include a safety mechanism configured to prevent discharge of the firearm when a safety lever is in a locked (safety on) position.

SUMMARY

Embodiments of a precision guided firearm and a trigger assembly that may be used in conjunction with a precision guided firearm are disclosed. The trigger assembly includes a trigger shoe and may include one or more components operable to selectively enable a pull on the trigger shoe to discharge the firearm.

In certain embodiments, a trigger assembly includes a bi-stable switch and associated actuator to selectively block or allow discharge of the firearm. The bi-stable switch may include one or more permanent magnets configured to maintain a state of the switch when a power supply to the actuator is interrupted. The actuator may include one or more permanent magnets and one or more electro-magnets configured to selectively alter a state of the switch. In certain aspects, the trigger assembly may include a blocking lever associated with the switch and including a roller configured to selectively engage or disengage a portion of a sear to prevent or allow discharge, respectively, of the firearm.

In certain embodiments, a trigger assembly includes a mechanism to automatically catch the hammer after discharge and to secure the hammer in a position to release again in the time it takes for a bolt-action rifle to cycle. In certain embodiments, the trigger assembly may include an actuator configured to move a hook to secure the hammer in the firing position.

In certain embodiments, a trigger assembly includes a sensor to detect the presence or absence of a particular optical device, such as a gun scope of a particular manufacturer.

In certain embodiments, the trigger assembly includes a control lever within a trigger guard of a firearm and accessible by a shooter to engage a human interface of an optical device coupled to the firearm. In certain embodiments, the control lever is accessible by a shooter to engage one or more menu options of the optical device. In certain embodiments, the control lever is accessible by a shooter to select a target within a view area of the optical device. In certain embodiments, the control lever may be pulled or pushed to engage different features of the optical device.

BRIEF DESCRIPTION OF THE DRAWINGS

In the following discussion, the same reference numbers are used in the various embodiments to indicate the same or similar elements.

DETAILED DESCRIPTION OF ILLUSTRATIVE EMBODIMENTS

In the following detailed description of embodiments, reference is made to the accompanying drawings which form a part hereof, and which are shown by way of illustrations. It is to be understood that features of various described embodiments may be combined, other embodiments may be utilized, and structural changes may be made without departing from the scope of the present disclosure. It is also to be understood that features of the various embodiments and examples herein can be combined, exchanged, or removed without departing from the scope of the present disclosure.

In accordance with various embodiments, the methods and functions described herein may be implemented as one or more software programs running on a processor, a field programmable gate array (FPGA), a controller, or any combination thereof. Dedicated hardware implementations including, but not limited to, application specific integrated circuits, programmable logic arrays, and other hardware devices can likewise be constructed to implement the methods and functions described herein. Further, the methods described herein may be implemented as a device, such as a computer readable storage medium or memory device, including instructions that when executed cause a processor to perform the methods.

Embodiments of a firearm system are described below that may include an optical device, such as a digital gun scope, which may be configured to communicate digital images to a display within the optical scope and, in certain embodiments, to external computing devices, such as smart phones, tablet computers, and the like. In certain embodiments, the optical device may communicate with a trigger assembly to send control signals and to receive sensor signals. In certain embodiments, the trigger assembly may include various components that may selectively enable discharge of the firearm in response to a control signal, such as when a selected target is aligned to a ballistic solution of the firearm and the user has pulled the trigger. Further, in certain embodiments, various components of the trigger assembly may be configured to enable rapid discharge of the firearm, such as by catching the hammer after discharge and holding it in a ready position for a next discharge. In certain embodiments, the trigger assembly may include a control lever that is accessible by a user to engage functions, modes, or other features of the optical device or of the firearm itself.

Figure 1:
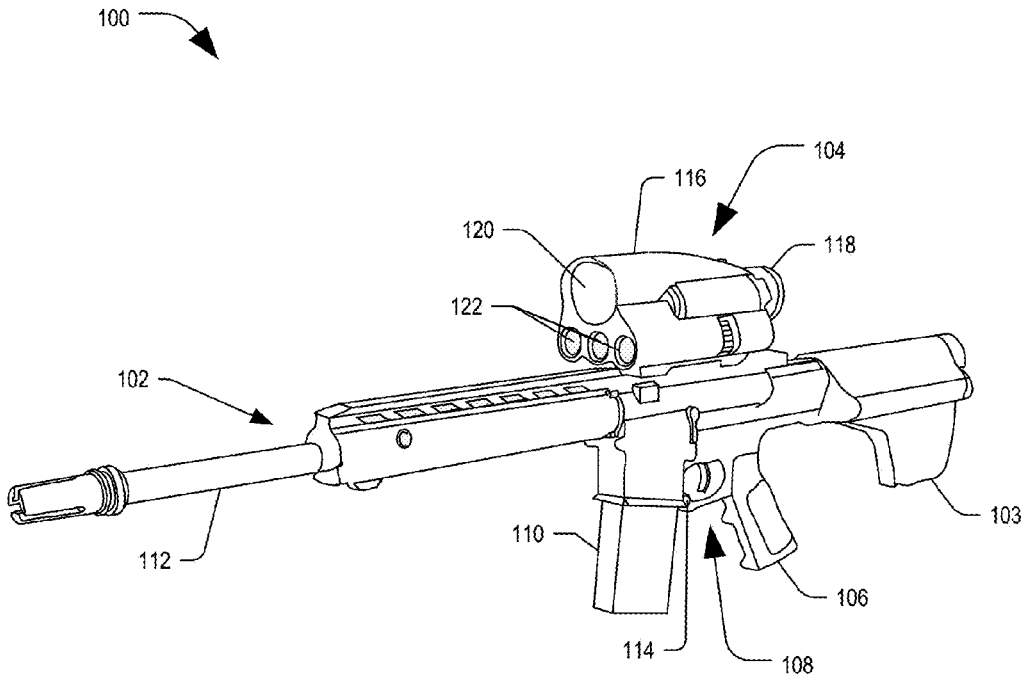
FIG. 1 is a perspective view of a firearm system including a trigger assembly according to certain embodiments.

Referring now to FIG. 1, a perspective view of a firearm system including the optical device is show and generally indicated at 100, according to some embodiments. The firearm system 100 includes a firearm 102 coupled to an optical device 104, such as a gun scope, which may be mounted to or integrated with a portion of the housing of the firearm 102. The firearm 102 may include a stock 103, a grip 106, a trigger assembly 108, a clip 110, and a muzzle 112. The firearm 102 may include one or more buttons or switches, such as button 114, which may be accessed by a user. The button 114 may be coupled to circuitry within the optical device 104 and may be accessed by the user to access functionality of the optical device 104. For example, a user may be able to control functions of the optical device 104 by manipulating controls located on the firearm 102. In some embodiments, a user may be able to use button 114 in order to "tag" or select an object within the view area of the optical device 104 as a target. In response to target selection, the optical device 104 may determine a range to the selected target and may use circuitry to calculate a ballistics solution for the target. Further, the circuitry within the optical device 104 may communicate with trigger assembly 108 to selectively enable discharge or prevent discharge of the firearm 102 based on the aim point relative to the ballistics solution. In certain embodiments, circuitry within the optical device 104 may selectively prevent discharge of the firearm 102 in response to the user pulling trigger 108 until the ballistic aim point is aligned to or predicted to be aligned with the tagged location on the target.

The optical device 104 includes a housing 116 that is configured to secure circuitry. The optical device 104 may include a viewing lens 118, one or more lenses 120 and 122. The lenses 120 may focus light toward one or more optical sensors, which may be configured to capture image data and to provide the image data to one or more processors. The circuitry may include a display that may be viewed through the viewing lens.

In certain embodiments, circuitry for image processing or other functions of the optical device 104 may be located within the firearm 102. For example, the optical device 104 and the firearm 102 may be integrated, so that at least some of the circuitry used by the optical device 104 may be located within the firearm 102. For example, circuitry for image processing data calculations, ballistics calculations, range calculations, other operations, or a combination thereof may be located in the grip 106, the stock 103, or in other parts of firearm 102. In certain embodiments, a power source for the optical device 104 may be located within the firearm 102, such as in the stock 103.

Figure 2:
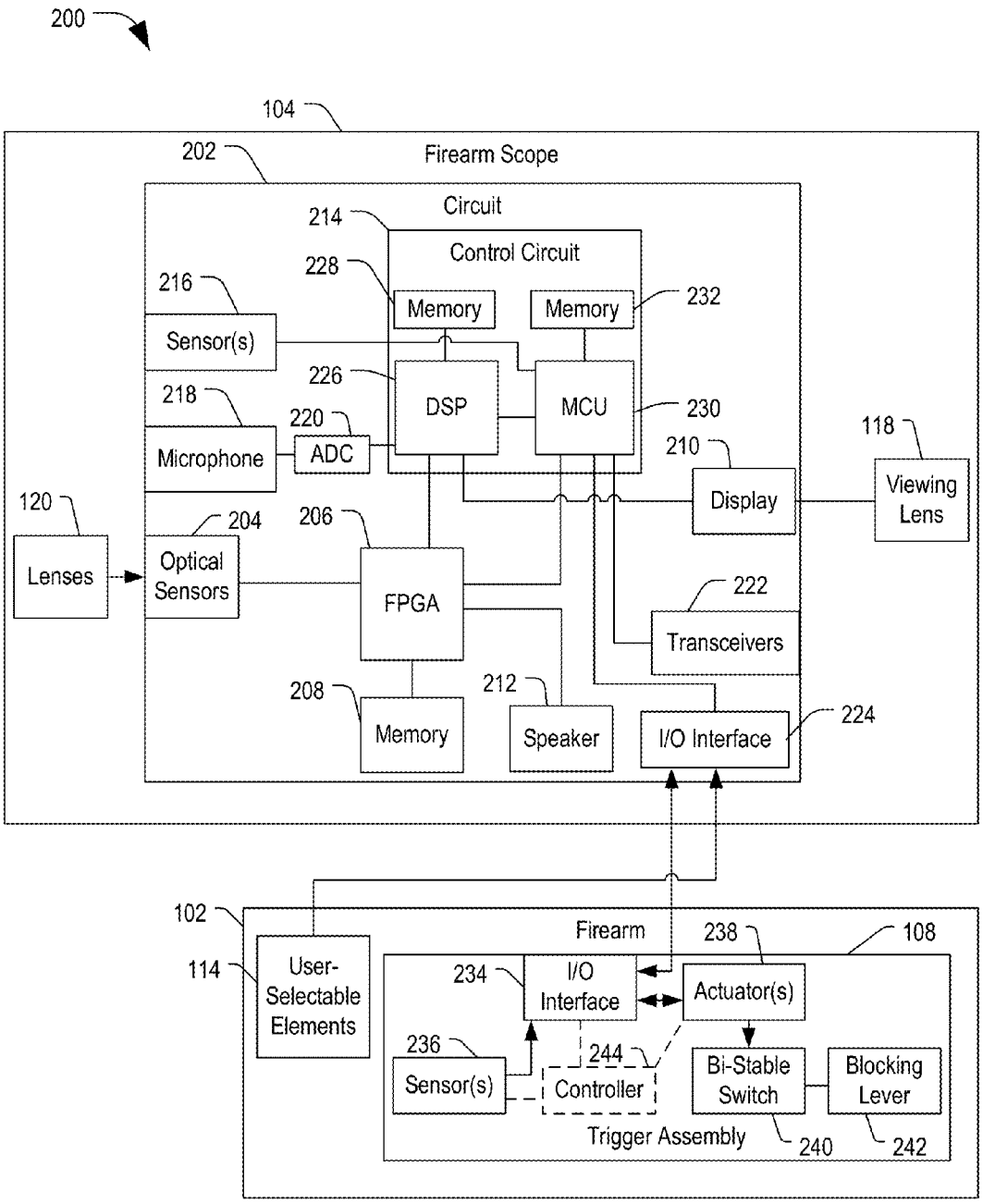
FIG. 2 is a block diagram of a firearm system according to certain embodiments.

Referring now to FIG. 2, a block diagram of a firearm system is described that includes a firearm scope and a firearm, and is generally designated as 200. The firearm system 200 may be an embodiment of the firearm system 100 depicted in FIG. 1, including the firearm 102 and the firearm scope 104. The firearm scope 104 includes a circuit 202, lenses 120, and viewing lens 118.

The circuit 202 may include optical sensors 204 configured to receive light directed through one or more lenses 120 of the firearm scope 104 and configured to provide data corresponding to received light to a field gate array (FPGA) 206, which may be couple to a memory 208 and to a digital signal processor (DSP) 226 and a microcontroller unit (MCU) 230 of a control circuit 214. The FPGA 206 may also be coupled to a speaker 212.

The control circuit 214 may include a memory 228 coupled to the DSP 226 and a memory 232 coupled to the MCU 230. The DSP 226 may be coupled to a microphone 218, which may capture sounds and may convert the sounds into an electrical signal, through an analog-to-digital converter (ADC) 220. In certain embodiments, the microphone 218 may be external to circuit 202, and circuit 202 may instead include an audio input jack or interface for receiving an electrical signal from the microphone 218. In a particular example, the speaker 212 and the microphone 218 may be incorporated in a headset worn by a user that is coupled to circuit 202 through an input/output interface (not shown). The DSP 226 may also be coupled to a display 210. The display 210 may be viewable via the viewing lens 118. Circuitry 120 can further include a microphone 128 to.

The MCU 230 may be coupled to one or more transceiver 222, which may include wireless transceivers configured to communicate images, text, sound, and other data to and from an external device, such as a smart phone, tablet computer, or other data processing device. The MCU 230 may also be coupled to an input/output (I/O) interface 224. The MCU 230 may also be coupled to one or more sensors 216, which may be configured to measure one or more environmental parameters (such as wind speed and direction, humidity, temperature, incline, elevation, orientation, motion, other parameters, or any combination thereof), and to provide the measurement data to MCU 134. In certain embodiments, the sensors 216 may include an inclinometer, an accelerometer, an altimeter, a barometer, a thermometer, and other sensor devices.

The firearm 102 may include one or more user-selectable elements 114 coupled to the I/O interface 224 and may include a trigger assembly 108. The trigger assembly 108, in addition to a trigger shoe, a sear, a hammer, actuators, switches and other mechanical components (shown in later figures), may include circuitry including an I/O interface 234 configured to couple to the I/O interface 224. The I/O interface 234 may be coupled to one or more sensors 236 and one or more actuators 238. The one or more actuators 238 may be coupled to a bi-stable switch 240, to one or more blocking mechanisms, such as blocking lever 242, and optionally to one or more hooks configured to capture the hammer of the firearm 102 after discharge. In certain embodiments, the trigger assembly 108 may include a controller 244 that may be responsive to signals from the one or more sensors 236, to control signals from control circuit 214, or both to selective enable discharge or disable discharge of a firing mechanism coupled to the trigger assembly 108 by controlling elements within the trigger assembly 108.

In certain embodiments, the FPGA 206 may be configured to process image data, range finding data, or other data from optical sensors 204. In certain embodiments, the FPGA 206 or the MCU 230 may be coupled to a range finding circuit (not shown) to transmit a laser beam toward a target within a view area and to receive reflected light from the laser beam at the optical sensors 204. In certain embodiments, the FPGA 206 can process the image data to enhance image quality through digital focusing and gain control. Further, the FPGA 206 can perform image registration and stabilization.

The DSP 226 may execute instructions stored in the memory 228 to process audio data from the microphone 218 or image data from the FPGA 206. In an example embodiment of an optical device that is a firearm scope 104, as a target moves within the view area, the DSP 226 can perform target tracking and can apply a visual marker to the target (within the image data), which can be shown on the display 210. The FPGA 206 and the DSP 226 may be configured to operate together to perform optical target tracking within the view area of the optical device that incorporates circuit 202. In some embodiments, the DSP 226 may be configured to combine image data obtained from multiple optical sensors 204 and to provide the combined images to the display 210. For example, if the optical device (firearm scope 104) is focused on a dark environment with isolated lighting, image information from a day sensor may be used to display the lighted area, combined with information from the night sensor for the darker areas. Image data from different sensors may be combined in other ways to improve image quality or achieve a desired characteristic or look for an image. For example, a heads-up display (HUD) may be superimposed over a view area image on display 210. The HUD may display information such as a target range, ambient conditions such as wind speed and direction, other information, or any combination thereof.

The MCU 230 can process instructions and settings data stored in the memory 232 and may be configured to control operation of the circuit 202. The FPGA 206 may be configured to operate in conjunction with the MCU 230 to mix the video data with reticle information and target tracking information (from the DSP 226) and to provide the resulting image data to the display 210. In some embodiments, the MCU 134 may switch which data to use from the optical sensors 204 for creating a display image. In some embodiments, the FPGA 206 or the MCU 330 may compare illumination data from optical sensors 204 to a threshold value, and if the illumination data falls below a threshold, the FPGA 206 or the MCU 330 may alter an operating mode of the optical device, such as switching from a daytime mode to a nighttime mode. For example, the MCU 330 may switch from a "day" setting using data from a daytime sensor to a "night" setting using data from a nighttime sensor if a measured light level falls below a threshold, or if a user changes a display setting manually. The MCU 330 may also be configured to determine when to combine image data from the optical sensors 204 for display. The MCU 330 may be configured to calculate distances using data from a laser range finder (LRF) or light detection and ranging (LiDAR) circuit (not shown), and may use distance data, data from the image sensor(s) 204 (i.e., reflected laser light), or other information to calculate ballistics information (e.g. a ballistics solution). Further, the MCU 3309 may be configured to send control signals through the I/O interface 224 to the circuitry of the trigger assembly 108 to control timing of discharge of the firearm and to selectively enable discharge or disable discharge.

In certain embodiments, the trigger assembly may include one or more levers that may be selectively moved or positioned to provide selected functionality. In a particular example, the trigger assembly 108 may include a blocking lever 242 that may be positioned and maintained in a selected state using a bi-stable switch that may be configured to secure a state of a blocking lever of the trigger assembly 108 during operation and that may be configured to maintain the state even when power is removed. One example of a trigger assembly including a bi-stable switch is described below with respect to FIG. 3.

Figure 3:
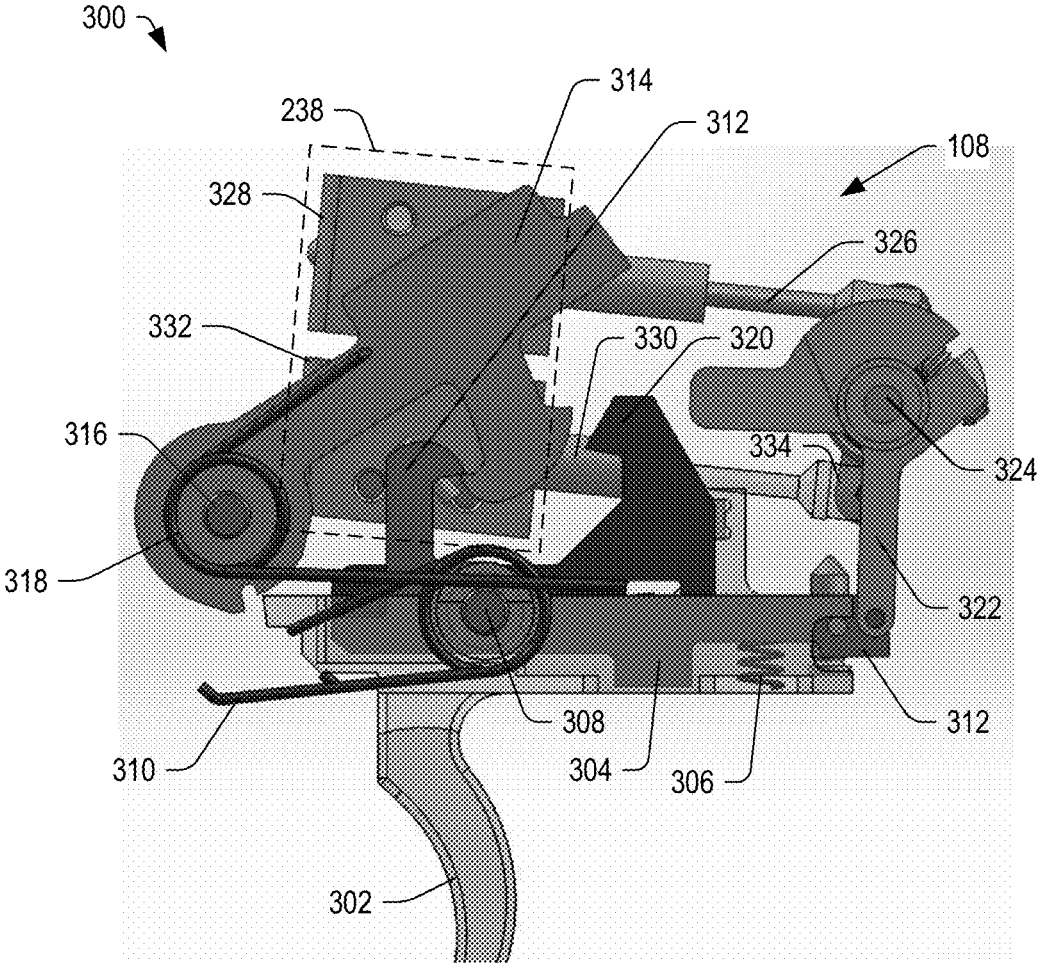
FIG. 3 is a diagram of a side view of a trigger assembly according to certain embodiments.

FIG. 3 is a diagram of a side view of a trigger assembly 300 according to certain embodiments. The trigger assembly 300 may be the trigger assembly 108 of FIGS. 1 and 2, according to certain embodiments. The trigger assembly 300 may include a trigger shoe 302 which may be coupled to a first sear 304 via a spring 306. The first sear 308 may be configured to pivot about an axis 308 and may include a spring 310 to apply a restoring force about the axis to return the first sear 308 to its initial position. The trigger assembly 300 may further include a main sear 312 configured to engage a hammer 314, which may be configured to pivot about an axis 316 and which may include a spring 318 to move the hammer 314 when the main sear 312 disengages.

The trigger assembly 300 may also include a disconnect mechanism 320 that is configured to selectively engage a portion of the hammer 314 that is opposite the sear 312 to hold the hammer 314 during a reset of the trigger assembly 300, such as after discharge and while the bolt is being moved by the shooter to eject a spent cartridge and to load an unused bullet. The trigger assembly 300 may further include a blocking lever 322 that is configured to move about an axis 324 in response to actuator plunger 326 and 330, which may be coupled to actuators 328 and 332 of an actuator circuit 238. The actuator plungers 326 and 330 may be coupled to one another and to a switch through an actuator linkage 334.

In certain embodiments, the actuator circuit 238 can hold the trigger assembly 108 in a safe position or a fire position without the continual application of electrical energy, which represents an important advancement in fire control for precision guided firearms. The actuator circuit 238 provides a bi-stable actuator and associated switching feature that has two positions (states) that may not stop or stick in an intermediate position (or state). In particular, the actuator circuit 238 in conjunction with the actuator plungers 326 and 330 and the actuator linkage 334 may increase the safety of the firearm 102 by utilizing permanent magnets to secure the switch, reducing the chance of an electronic failure or a wiring problem, reducing risk associated with changing states in response to a power interruption, and reducing the potential danger of a trigger malfunction in response to a software failure. From a power consumption standpoint, the actuator circuit 238 may utilize power only to switch states and may use no power to hold the bi-stable switch in a safe position. In certain embodiments, the circuit control circuitry may be battery powered and operated, and the low power usage may extend the battery life of the device. Moreover, the bi-stable switch may function as an electronic safety and thus prevent the gun from firing unless the bi-stable switch is in a "enable" discharge state.

In certain embodiments, the actuator linkage 334 is balanced such that an impact (weapon firing or accidental drop) does not cause the bi-stable switch or the actuator circuit 238 to change position. In certain embodiments, the actuator circuit 238 includes or is coupled to two moveable actuator plungers 326 and 330, which may be connected thru the actuator linkage 334. In certain embodiments, the actuator plungers 326 and 330 are constrained to move inside a wire coil and close to a permanent magnet of actuators 328 and 332, respectively. When the actuator plunger 326 moves out of the coil and away from the permanent magnet of the actuator 328, the actuator plunger 330 moves into the coil and toward the permanent magnet of the actuator 332. In certain embodiments, the coils of the actuators 228 and 332 may be electrical wires configured to generate a magnetic field in response to electrical current and may operate to supplement (or offset) the polarity of the permanent magnet in order to switch the state of the actuator plungers 326 and 330. In certain embodiments, the coils may be connected in opposite directions such that one permanent magnet attracts the iron core of the actuator arm 326 or 330, and the magnetic field in the other coil may cancel the magnetic field of a permanent magnet. The reversal of the electrical polarity may overcome the magnetic fields of the magnets to cause the actuator plungers 326 and 330 to reverse directions.

The sear 304 of the trigger assembly 108 may interact with a blocking lever 322 associated with the bi-stable actuator, including the actuator circuit 238 (actuators 328 and 332), actuator plungers 326 and 330, and the actuator linkage 334 such that the blocking lever 322 may block the main sear 312 from moving to release the hammer 324. The trigger shoe 302 may be pulled by a shooter, applying a spring load force from spring 306 to the main sear 312, which may be held by the blocking lever 322. When the bi-stable actuator including the actuator circuit 238 (actuators 328 and 332), actuator plungers 326 and 330, and the actuator linkage 334 cause the blocking lever to move relative to the axis 324, the blocking lever 322 is moved out of the way and the trigger shoe 302 may be pulled. In this example, the spring 306 that is loaded by pulling the trigger shoe 302 forces the main sear 312 to release the hammer 314, and the spring load from spring 318 causes the hammer 314 to turn about axis 316 and strike the firing pin (not shown).

In response to striking the firing pin, the projectile is discharged through the muzzle 112 of the firearm 102, and the hammer 314 may rebound, rotating clockwise about the axis 316 (shown in FIG. 3). As the semi-automatic hammer action is cycled, the hammer 314 swings back and engages the disconnect mechanism 320 (if the shooter is still pulling on the trigger shoe 302). As the shooter releases the trigger shoe 302, the main sear 312 shifts back and the hammer 314 may be held by the main sear 312. The bi-stable actuator circuit 238, actuator plungers 326 and 330, actuator linkage 334 and blocking lever 322 can cycle into position again to block the main sear 312 in preparation for the next shot.

In certain embodiments, the trigger assembly 108 may be configured to function like a traditional semi-automatic trigger. When the trigger shoe 302 is pulled and the blocking-lever 322 does not restrict the release of the main sear 312, the main sear 312 releases the hammer 314.

Figure 4:
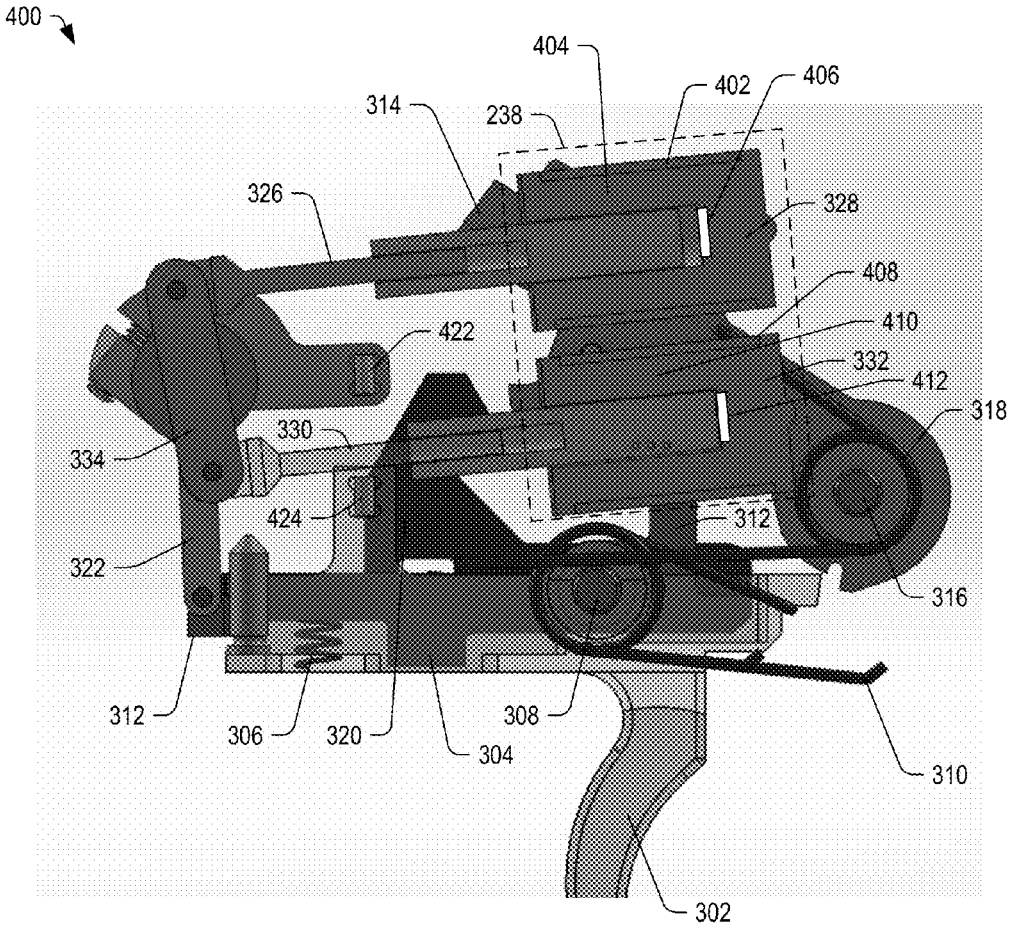
FIG. 4 is a diagram a side view of the trigger assembly of FIG. 3 from an opposite side according to certain embodiments.

Referring now to FIG. 4, a side view of the trigger assembly 300 of FIG. 3 opposite to the view of FIG. 3 is shown and generally designated 400, according to certain embodiments. The trigger assembly 400 has all of the elements of trigger assembly 300. Further, actuator 328 may include a coil 402 surrounding an iron core 404 to form an electromagnet and may include a permanent magnet 406. Similarly, actuator 332 may include a coil 408 surrounding an iron core 410 to form an electromagnet and may include a permanent magnet.

In certain embodiments, the coil and the coil 408 may include two coils to allow for fast switching of the polarity of the electromagnet. In certain embodiments, the coil 402 and the coil 408 may be energized with opposite polarities and the permanent magnets 406 and 412 may have the same polarities, such that the coils 402 and 408 either augment or offset the magnetic field of the permanent magnet in order to move the actuator plungers 326 and 330, moving the actuator linkage 334 and the associated blocking arm 322.

In certain embodiments, the trigger assembly 400 may include a sensor 424, which may be a Hall effect sensor, configured to detect a relative position of the blocking lever 322 based on a magnetic field from a magnet 422 disposed on a portion of the blocking lever 322. A printed circuit board (not shown) may be coupled to one or both sides of the trigger assembly 400 and to the Hall Effect sensor 424 to receive signals from the sensor 424 and to provide control signals to the actuator circuitry 238.

Figure 5A:
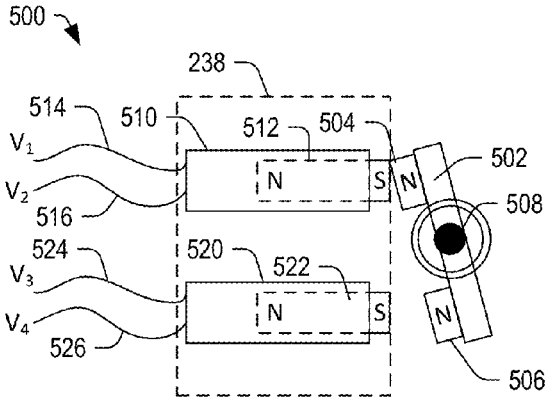
FIGS. 5A-5C are diagrams of an actuator system including an actuator and a bi-stable switch according to certain embodiments.
Figure 5B:
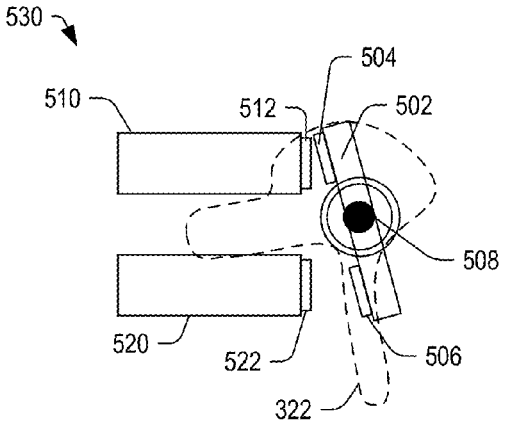
Figure 5C:
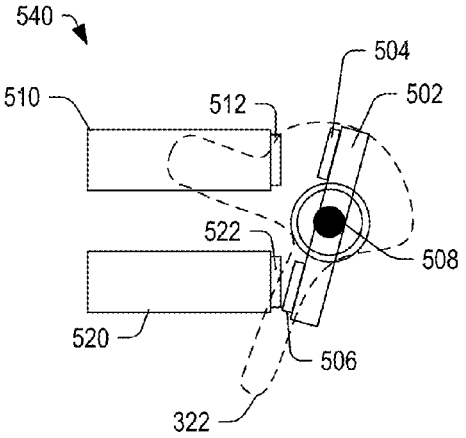

FIGS. 5A-5C are diagrams of an actuator system including an actuator and a bi-stable switch according to certain embodiments. In FIG. 5A, the actuator system 500 includes the actuator circuit 238 including electromagnets 510 and 520 and including permanent magnets 512 and 522. The electromagnet 510 may include a first electrical input 514 and a second electrical input 516, which may be configured to receive a first voltage ($V_1$) and a second voltage ($V_2$), respectively. The electromagnet 520 may include a first electrical input 524 and a second electrical input 526, which may be configured to receive a third voltage ($V_3$) and a fourth voltage ($V_4$), respectively. In certain embodiments, the second voltage ($V_2$) and the third voltage ($V_3$) may be ground, while the first voltage ($V_1$) and the fourth voltage ($V_4$) may be at a higher or lower voltage potential.

The actuator system 500 may include a rotary, bi-stable switch 502 that may include a permanent magnet 504 on a first end, a permanent magnet 506 on a second end, and an axis 508 about which the bi-stable switch 502 may rotate.

In certain embodiments, the permanent magnet 504 is magnetically attracted to the permanent magnet 504. Additionally, the permanent magnet 506 is magnetically attracted to the permanent magnet 522. When no voltage is applied to either electromagnet 510 or 520, the magnetic field holds the magnet 504 in contact with the magnet 512, and the magnetic field between magnets 506 and 522 is insufficient to change the state of the bi-stable switch 502. To change the state, a first differential voltage is applied to the first and second electrical inputs 514 and 516 to produce a magnetic field that substantially cancels the magnetic field of the permanent magnet 512. Additionally, a second differential voltage is applied to the electrical inputs 524 and 526 to produce a magnetic field that substantially amplifies the magnetic field to supplement the field produced by the permanent magnet 522 in order to attract the permanent magnet 506 more forcefully. By cancelling or offsetting the magnetic field of the permanent magnet 512 and by augmenting or amplifying the magnetic field of the permanent magnet 522, the actuator circuit 238 may move the bi-stable switch 502 about the axis 508 until the permanent magnet 506 contacts the permanent magnet 522, for example.

Referring now to FIG. 5B, the actuator system is shown in conjunction with a blocking lever 322, and is generally indicated at 530. The actuator system 530 depicts the blocking lever 322, which may be configured to rotate about the axis 508 in conjunction with the bi-stable switch 502. The blocking lever 322 is depicted in an unblocked state or mode.

Referring now to FIG. 5C, the actuator system is shown in conjunction with the blocking lever 322, and is generally indicated at 530. The actuator system 530 shows that the bi-stable switch 502 has changed states, such that the permanent magnet 506 is contacting permanent magnet 522, pivoting the bi-stable switch 502 about the axis 508. The rotation of the bi-stable switch 502 has moved the blocking lever 322.

It should be appreciated that the embodiments of FIGS. 5A-5C differ from the embodiments of FIGS. 3 and 4 in that the actuator arms 326 and 330 are omitted in favor of moving the bi-stable switch 502 directly with the magnetic fields, as opposed to indirectly with the actuator arms. While the embodiments differ, either embodiment may be used to move a switch, such as bi-stable switch 502, a lever, such as blocking lever 322, or any combination thereof.

Figure 6:
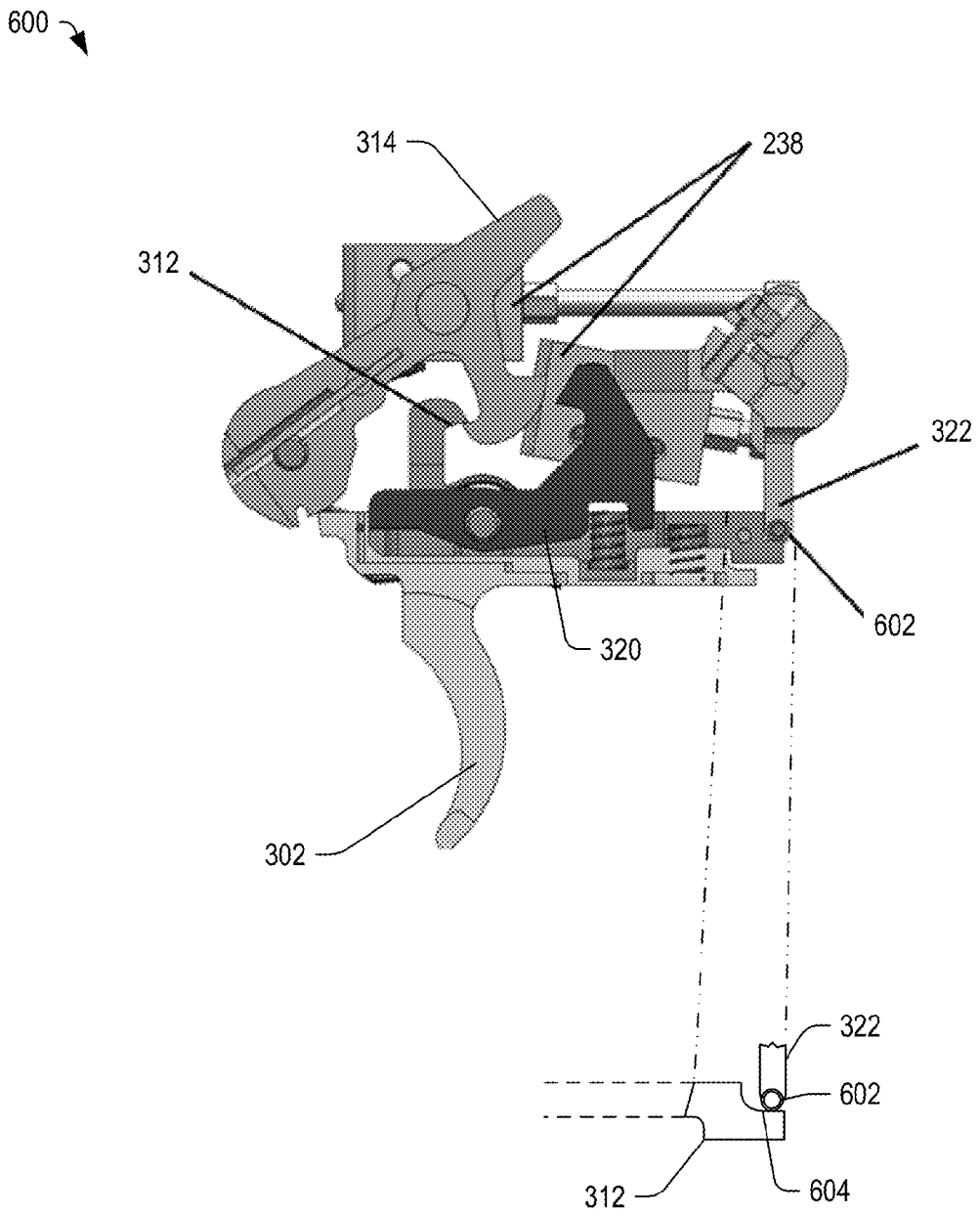
FIG. 6 is a diagram of a trigger assembly including a blocking lever having a roller according to certain embodiments.

FIG. 6 is a diagram of a trigger assembly 600 including a blocking lever 322 having a roller 602 according to certain embodiments. The trigger assembly 600 may include a trigger shoe 302 that may be configured to move a main sear 312, which may release a hammer 314. The trigger assembly 600 further includes actuator circuitry 238 and associated actuator plungers and actuator linkage coupled to the blocking lever 322. The blocking lever 322 may include a roller 602 configured to contact a ledge or contact location 604 on the main sear 312, in a first mode, to prevent movement of the main sear 312 in response to movement of the trigger shoe 302. In a second mode, the blocking lever 322 may be moved such that the roller 602 is not in contact with the ledge or contact location 604, allowing the main sear 312 to release the hammer 314.

In certain embodiments, the blocking lever 322 is configured to selectively prevent the firing of the firearm 102 in response to a trigger pull until a control circuit within an optical device, such as firearm scope 104 sends a signal to the actuator circuit 238 to enable firing. In certain embodiments, small actuators, such as the actuators 328 and 332 may have relatively little force to move or hold position under the load applied to the main sear 314; however, the permanent magnets 504, 506, 512, and 522 may operate to maintain a rotational position of the bi-stable switch 502, holding it in position with or without electrical power supplied to the actuator circuit 238.

The blocking lever 322 may be oriented at an angle that is substantially perpendicular to the movement of a portion of the main sear 312 such that it can resist movement of the main sear motion 322 without additional holding force. In this orientation, a compression force may be applied to the blocking lever 322 by the main sear 312 in response to a trigger pull; however, no backward torque is applied to the actuator linkage 344 or to the bi-stable switch 502. In certain embodiments, a blocking lever 322 that has a low friction roller 602 at the tip will act as a bearing and change sliding friction to rolling friction, reducing the friction that might otherwise require additional torque from the bi-stable switch to move the blocking lever 322 into and out of contact with the contact location 604 of the main sear 312.

Figure 7:
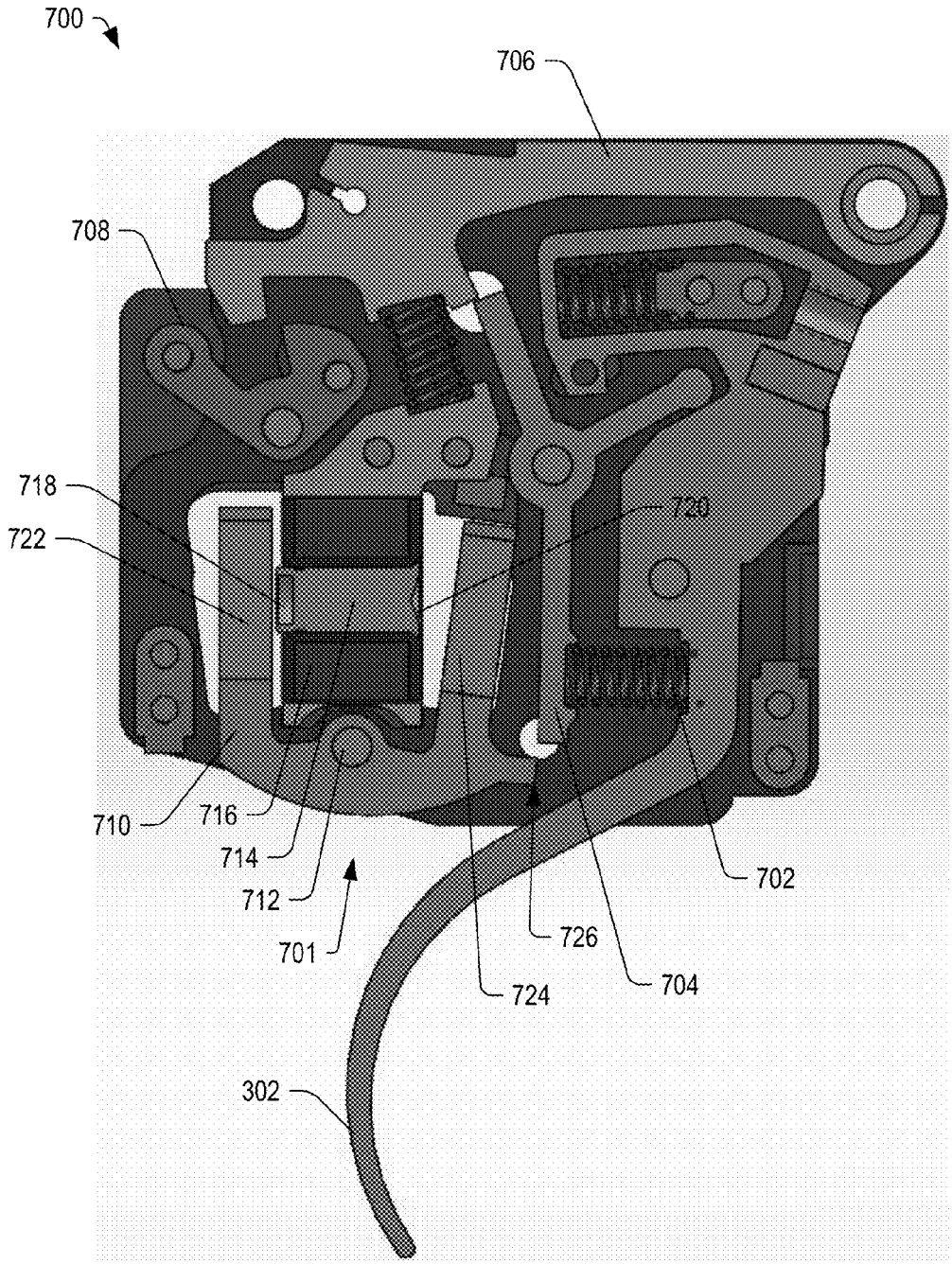
FIG. 7 is a diagram of a trigger assembly including a bi-stable switch according to certain embodiments.

FIG. 7 is a diagram of a trigger assembly 700 including a bi-stable switching mechanism, generally indicated at 701, according to certain embodiments. The trigger assembly 700 includes a trigger shoe 302 that is coupled by a spring 702 to a main sear 704, which may move to release the hammer 706. The trigger assembly 700 includes a safety mechanism 708 that may be rotated about an axis to contact a portion of the hammer 706 to prevent discharge.

The trigger assembly 700 further includes a bi-stable switching mechanism 701 that includes a u-shaped switch 710 having a first arm including a permanent magnet 722 and including a second arm having a permanent magnet 704. The u-shaped switch 710 is configured to pivot about an axis 712 and includes an L-shaped portion 726 configured to contact the main sear 704, in a first mode, to prevent discharge of the firearm. The bi-stable switching mechanism 701 further includes an iron core 714 surrounded by one or more conductive coils 716 and permanent magnets 718 and 720 on opposite sides. In a second mode, the permanent magnet 722 is moved into contact with the permanent magnet 718, which moves the L-shaped portion 726 away from the main sear 704, allowing discharge of the firearm.

In certain embodiments, in a first mode, current is provided to the coil 716 in a first direction, counteracting the magnetic field of the permanent magnet 718 and augmenting the magnetic field of the permanent magnet 720 to rotate the u-shaped switch 710 about the axis 712 and bringing the L-shaped portion into contact with the main sear 704. In a second mode, the current may be provided to the coil 716 in a second direction, counteracting the magnetic field of the permanent magnet 720 and augmenting the magnetic field of the permanent magnet 718 to rotate the u-shaped switch 710 about the axis 710 and moving the L-shaped portion away from the main sear 704.

In certain embodiments, the permanent magnets 718 and 722 or the permanent magnets 720 and 724 may hold the u-shaped switch 710 in its state, even when power is removed. Further, the permanent magnets 718 and 722 or the permanent magnets 720 and 724 may maintain the state of the bi-stable switching mechanism 701 in response to shock events.

Figure 8:
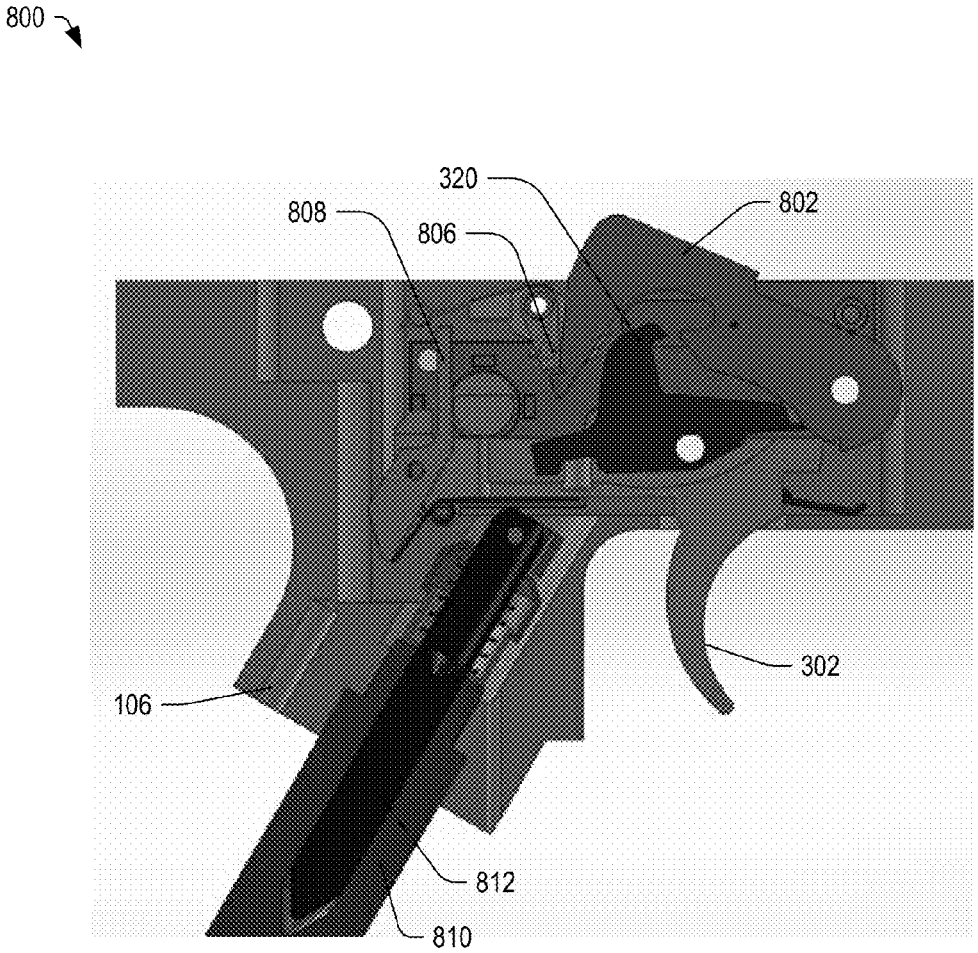
FIG. 8 is a diagram of a trigger assembly configured to provide an automatic firing capability in a precision controlled firearm according to certain embodiments.

FIG. 8 is a diagram of a trigger assembly 800 configured to provide an automatic firing capability in a precision controlled firearm according to certain embodiments. The trigger assembly 800 includes a trigger shoe 302, a disconnect mechanism 320 responsive to the trigger shoe 302 to pivot forward toward a hammer 802. The trigger assembly 800 further includes a hook 806 and a locking mechanism 808. The trigger assembly 800 may also include an actuator 810 and an actuator arm 812 (within the grip 106), which may operate to move the hook 806 to catch the hammer 802 and to allow the disconnect mechanism 320 to engage the hammer 802 while a bolt is being reset to allow the trigger assembly 800 to fire again in the time it takes for the bolt to cycle. In certain embodiments, there may be a semi-automatic manual override mode on the safety selector. In certain embodiments, the trigger assembly 800 may be configured to release tracked shots on pre-selected targets without the shooter having to cycle the trigger. In certain embodiments, the second actuator 810 and the actuator arm 812 may couple to the hook 806 to provide an independent sear to selectively prevent discharge of the firearm.

Figure 9:
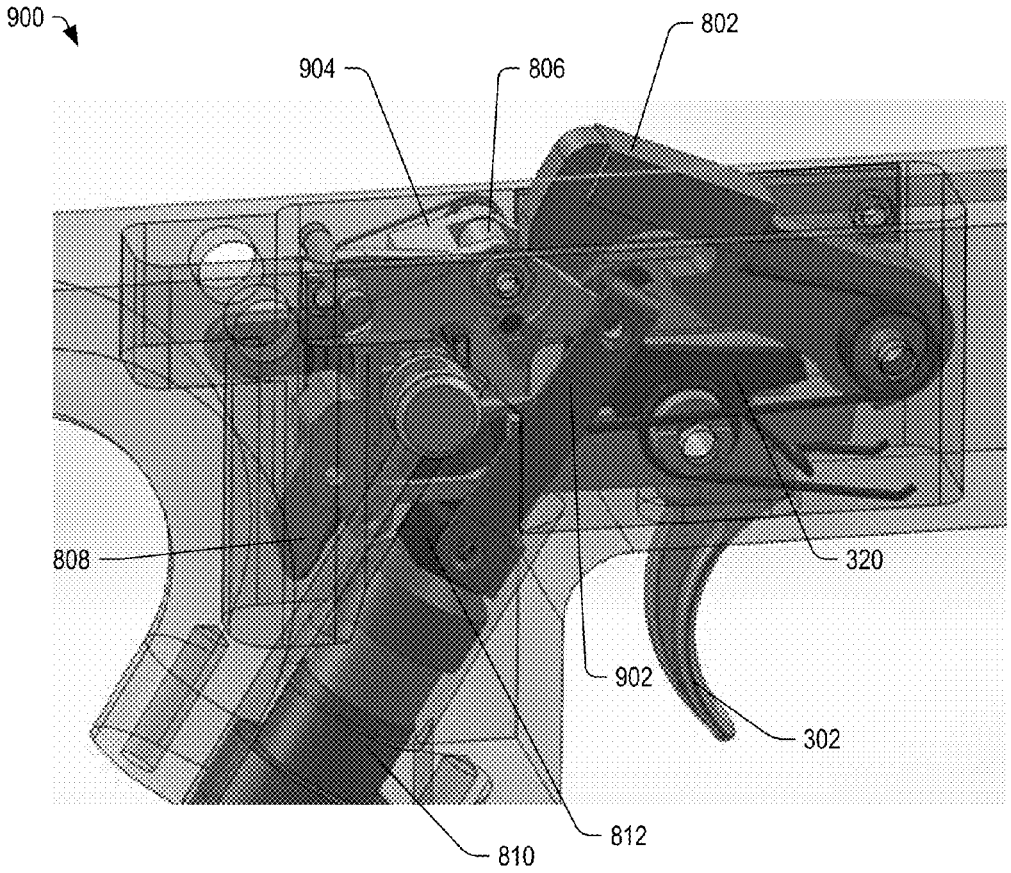
FIG. 9 is a diagram of the trigger assembly of FIG. 8 including additional components according to certain embodiments.

FIG. 9 is a diagram 900 of the trigger assembly 800 of FIG. 8 including additional components that were obscured in the view of FIG. 8, according to certain embodiments. The diagram 900 includes all of the elements of trigger assembly 800 and includes a first actuator linkage 902 that extends from the actuator arm 812 to a hook linkage 904 that pivots about an axis to move the hook 806 into position to engage the hammer 802. Additionally, locking mechanism 808 includes an arm portion that may engage a portion of the hook linkage 904 to prevent movement of the hook 806 in certain instances.

Figure 10:
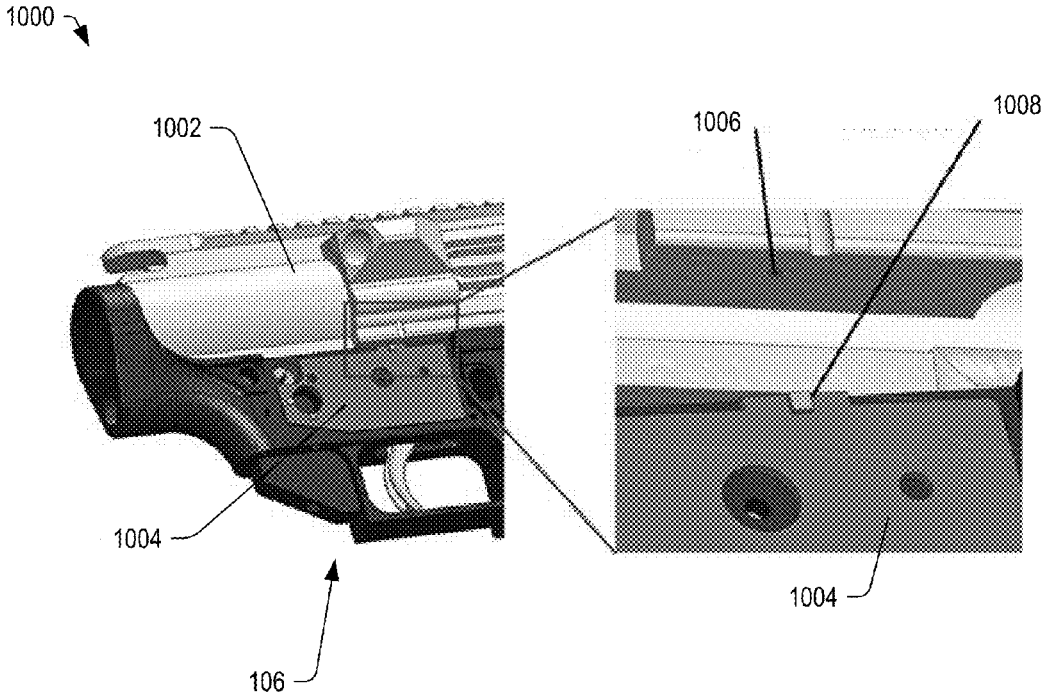
FIG. 10 is a perspective view of a portion of a firearm system including an interlock feature according to certain embodiments.

FIG. 10 is a perspective view of a portion of a firearm system 1000 including an interlock feature according to certain embodiments. The portion of the firearm system 1000 includes an upper mount portion 1002 configured to mate with an optical device, such as the firearm scope 104 in FIGS. 1 and 2. The portion of the firearm system 1000 further includes a trigger assembly 106 including a printed circuit board 1004. The printed circuit board 1004 may include a Hall Effect sensor (or other sensor) 1008 configured to detect a magnet or other detectable component coupled to a firearm scope 104.

In certain embodiments, a user may remove an optical device from the mount portion 1002 of a firearm system and may attach an upper device (such as another optical device) from a different manufacturer. The sensor 1008 may detect the presence or absence of the firearm scope 104 and may alter its operation in response to detecting the absence of the firearm scope 104 or the presence of a different type of scope or device (or a device from a different manufacturer). In a particular example, the sensor 1008 may be configured to interrogate an upper device, such as through a radio frequency signal, and to communicate with a control circuit configured to selectively enable or disable features of the trigger assembly 106 in response to the interrogation process.

In certain embodiments, a magnet 1006 installed in the bottom of the upper component can come into close proximity to a Hall effect sensor 1008 on the printed circuit board 1004. When the magnet 1006 is present, the sensor 1008 provides a signal that may be sent to a controller of the trigger assembly 106, to the upper device (i.e., the firearm scope 104), or both. When the magnet 1006 is not present, the sensor 1008 detects an absent upper device or an unapproved upper device, and the sensor 1008 may send a signal to a controller of the trigger assembly 106, which may be within the optical device (upper device) or on the printed circuit board 1004, and the controller may have the capability of disabling or locking-out certain features of the firearm system 1000.

Figure 11:
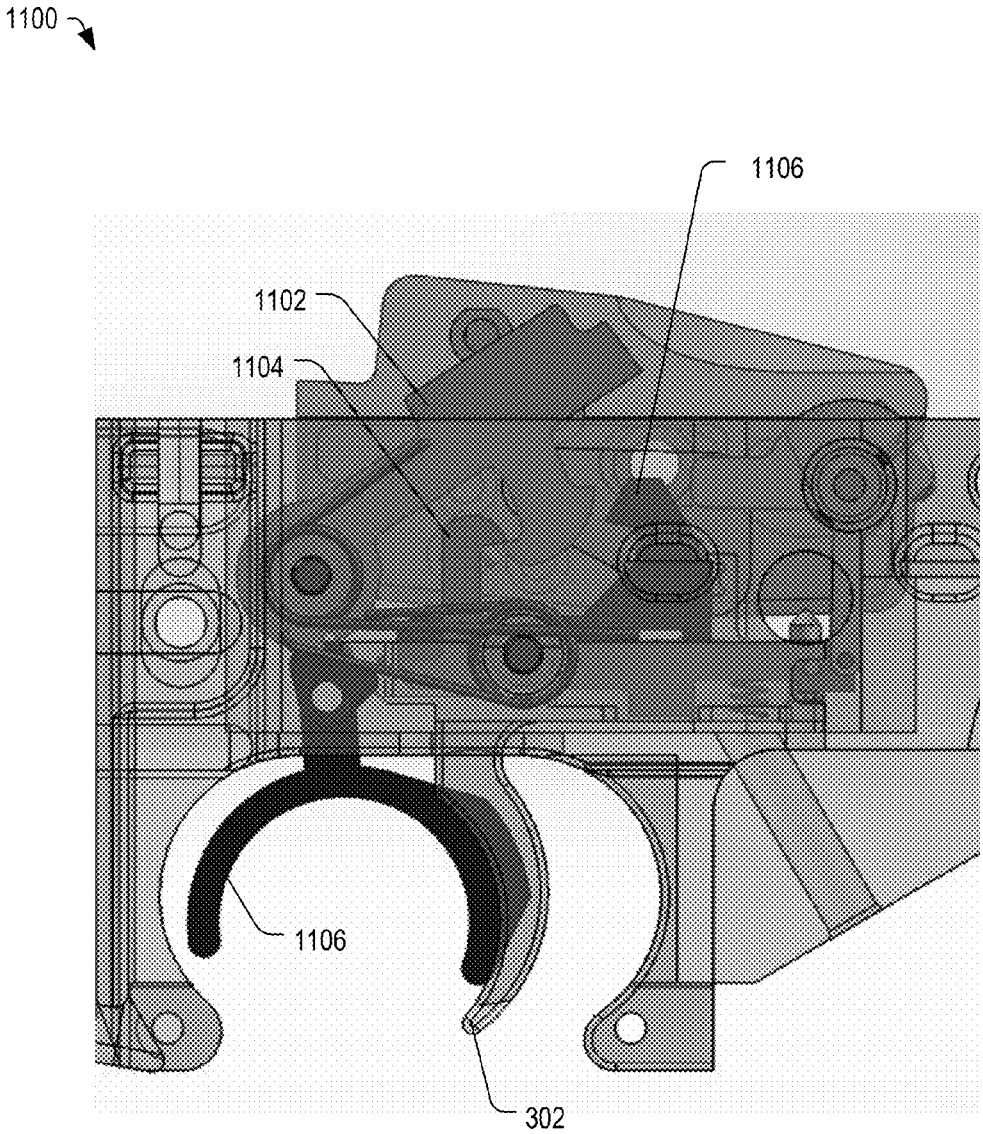
FIG. 11 is a diagram of a trigger assembly including a trigger shoe and a user accessible input interface according to certain embodiments.

FIG. 11 is a diagram of a trigger assembly 1100 including a trigger shoe 302 and a user accessible input interface 1106 according to certain embodiments. The user accessible input interface 1106 may include a dual-face trigger switch that may be pulled or pushed to move a lever extending into the trigger assembly, which movement may be detected by one or more sensors of a circuit. Movement of the user-accessible input interface 1106 may be used to access menu items and features of an optical device, such as firearm scope 104 in FIGS. 1 and 2.

In certain embodiments, the user-accessible input interface 1106 provides an intuitive and easily accessible human interface. Locating the user-accessible input interface 1106 within the trigger guard of the firearm system allows a user to easily access menu options within the firearm scope 104 without having to remove his/her finger from the trigger. In certain embodiments, the user-accessible input interface 1106 includes a lever such that it can be pulled before the actual trigger shoe 302 is moved by the finger. The motion of the user-accessible input interface 1106 can be assigned various functions in the software sequence of the firearm scope 104. Additionally, the user-accessible input interface 1106 can be pulled by the shooter's finger or can be pushed to access and control different functions within the firearm scope 104. The trigger shoe 302 may include a recessed portion to receive the user-accessible input interface 1106 when the user pulls it. The user-accessible input interface 1106 may be configured to center itself and may have hard stops at each end of its travel profile. The user-accessible input interface 1106 may have different methods of converting the motion to electrical input for the scope. In certain embodiments, the circuit may include a Hall Effect sensor and a magnet to detect movement of the user-accessible input interface 1106. In certain embodiments, the user-accessible input interface 1106 may be moved by the user to access functions within the firearm scope 104, such as target selection (tagging a target within the visual images of the scope), target ranging, engaging of the electronic safety, toggling between shooting modes, and so on.

Figure 12A:
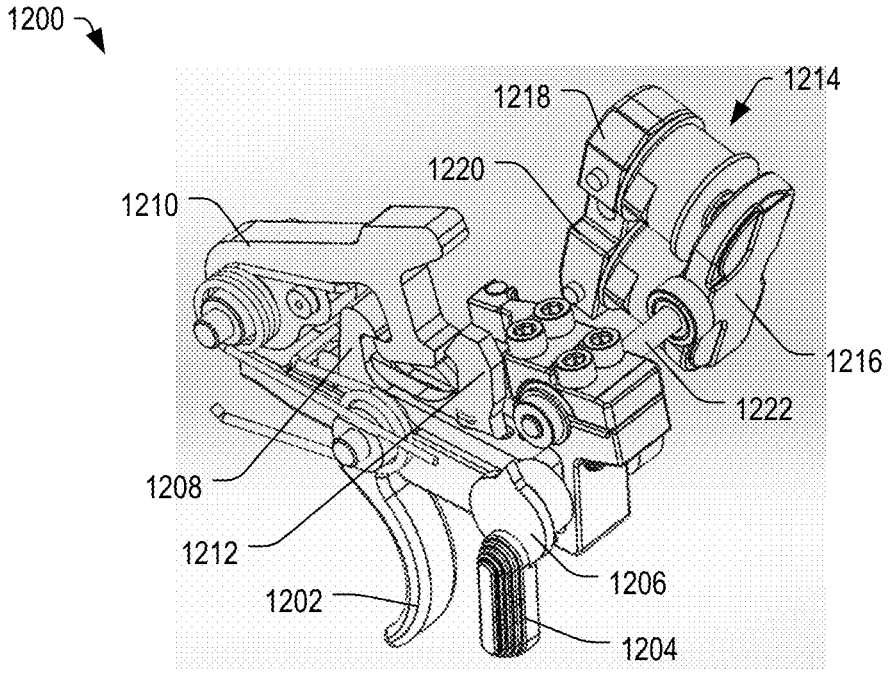
FIGS. 12A and 12B are perspective views of a trigger assembly including a bi-stable switch according to certain embodiments.
Figure 12B:
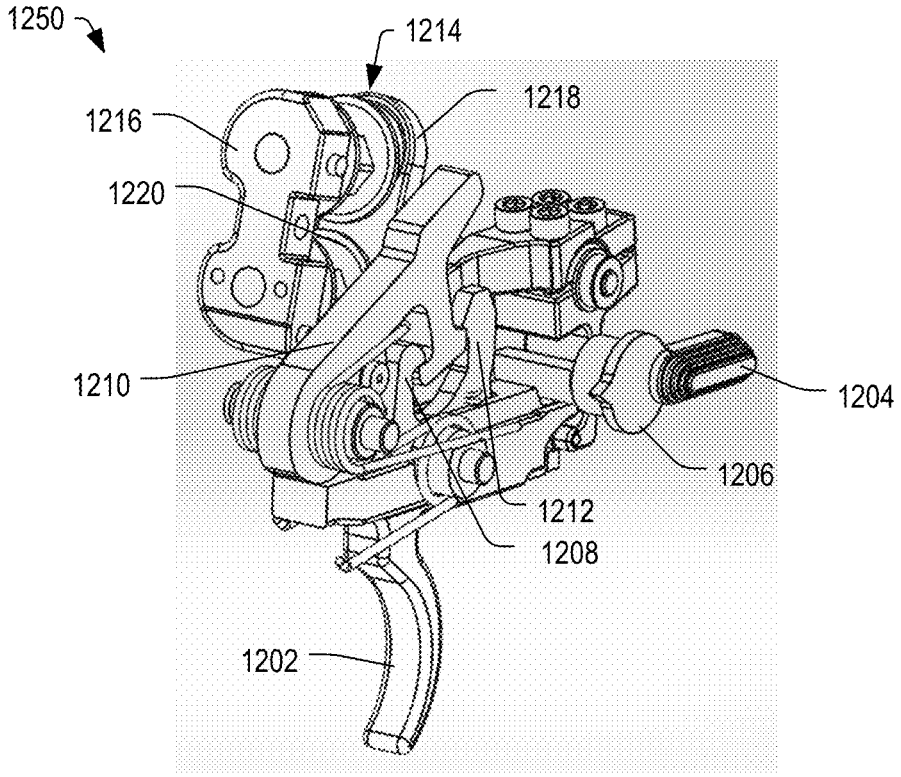

FIGS. 12A and 12B are perspective views of a trigger assembly 1200 including a bi-stable switch according to certain embodiments. The trigger assembly 1200 includes a trigger shoe 1202, which may be coupled to a main sear 1208 via a spring. The main sear 1208 may be configured to secure a hammer 1210 and to release the hammer 1210 in response to a shooter pulling on a trigger portion of the trigger shoe 1202. In certain embodiments, the main sear 1208 may be selectively blocked by a safety cam 1206, which may be controlled by a safety lever 1204. The trigger assembly 1200 may further includes a disconnect mechanism 1212, which may operate to catch the hammer 1210 after recoil of the hammer 1210 after the bullet is fired and while the trigger shoe 1202 is still being pulled.

Additionally, the trigger assembly 1200 may include a bi-stable switch including an actuator portion 1214 and a switching portion 1216. The actuator portion 1214 may include a first actuator 1218 and a second actuator 1220, which may be configured to selectively move the switching portion 1216 about an axis 1222. In certain embodiments, the movement of the switching portion 1216 may move a blocking lever into and out of engagement with the main sear 1208 to selectively permit release of the hammer 1210.

In certain embodiments, the safety lever 1204 oriented in a downward direction may cause the safety cam 1206 to physically block the main sear 1208 to prevent discharge. In FIG. 12B, the trigger assembly is generally indicated at 1250 and includes all of the elements of the trigger assembly 1200 of FIG. 12A. In the illustrated example, the safety lever 1204 of the trigger assembly 1250 is oriented in a horizontal direction, which changed the rotational state of the safety cam 1206. The safety cam 1206 disengaged the main sear 1208, allowing the main sear 1208 to release the hammer 1210, as long as the blocking lever (shown as 1302 in FIG. 13) is not engaged with an engagement surface of the main sear 1208.

Figure 13:
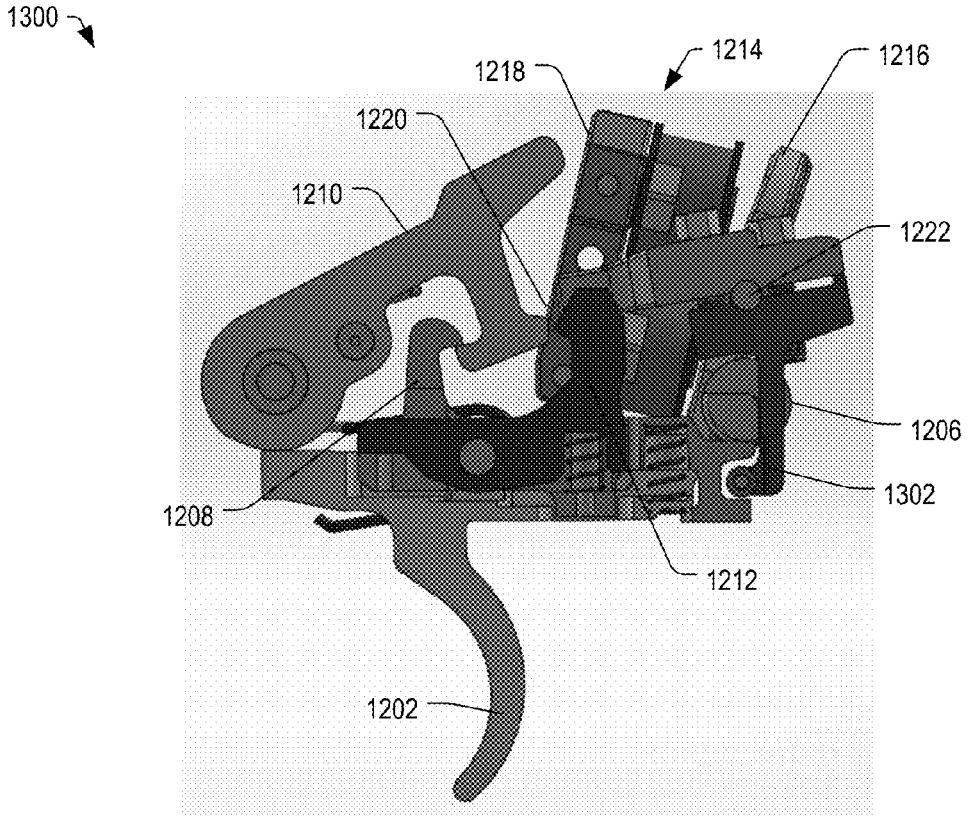
FIG. 13 is a side view of the trigger assembly of FIGS. 12A and 12B in a blocked state with the trigger in a "not pulled" state and a safety on, according to certain embodiments.

FIG. 13 is a side view of the trigger assembly, generally indicated at 1300, which may be an example of the trigger assembly 1200 and 1250 of FIGS. 12A and 12B, respectively. The trigger assembly 1300 is shown in a blocked state with the trigger shoe 1202 in a "not pulled" state and a safety on (represented by the orientation of the safety cam 1206), according to certain embodiments. In certain embodiments, the trigger assembly 1300 includes a blocking lever 1302, which may contact the main sear 1208 when the trigger assembly is in a blocked state.

Figure 14:
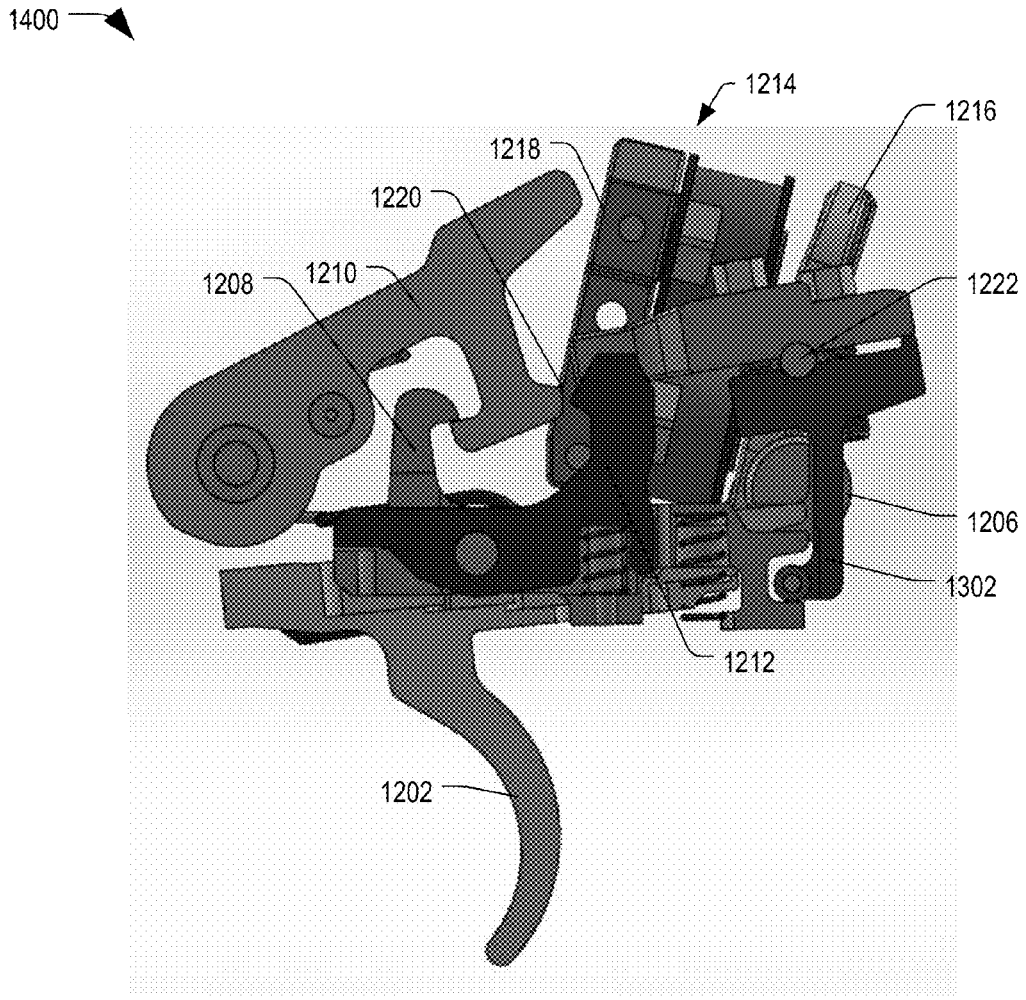
FIG. 14 is a side view of the trigger assembly of FIGS. 12A and 12B in a blocked state with the trigger pulled and the safety off, according to certain embodiments.

FIG. 14 is a side view of the trigger assembly 1200 of FIGS. 12A and 12B, generally indicated at 1400. The trigger shoe 1400 is shown in a blocked state with the trigger shoe 1202 pulled and the safety off (represented by the orientation of the safety cam 1206), according to certain embodiments. In the illustrated example, the trigger shoe 1202 is pulled, and the blocking lever 1302, held in state by the bi-stable switch including actuator circuit 1214 and switching portion 1216 is preventing movement of the main sear 1208 pending a control signal from a controller, such as a control circuit within a rifle scope communicatively coupled to the trigger assembly 1400.

Figure 15:
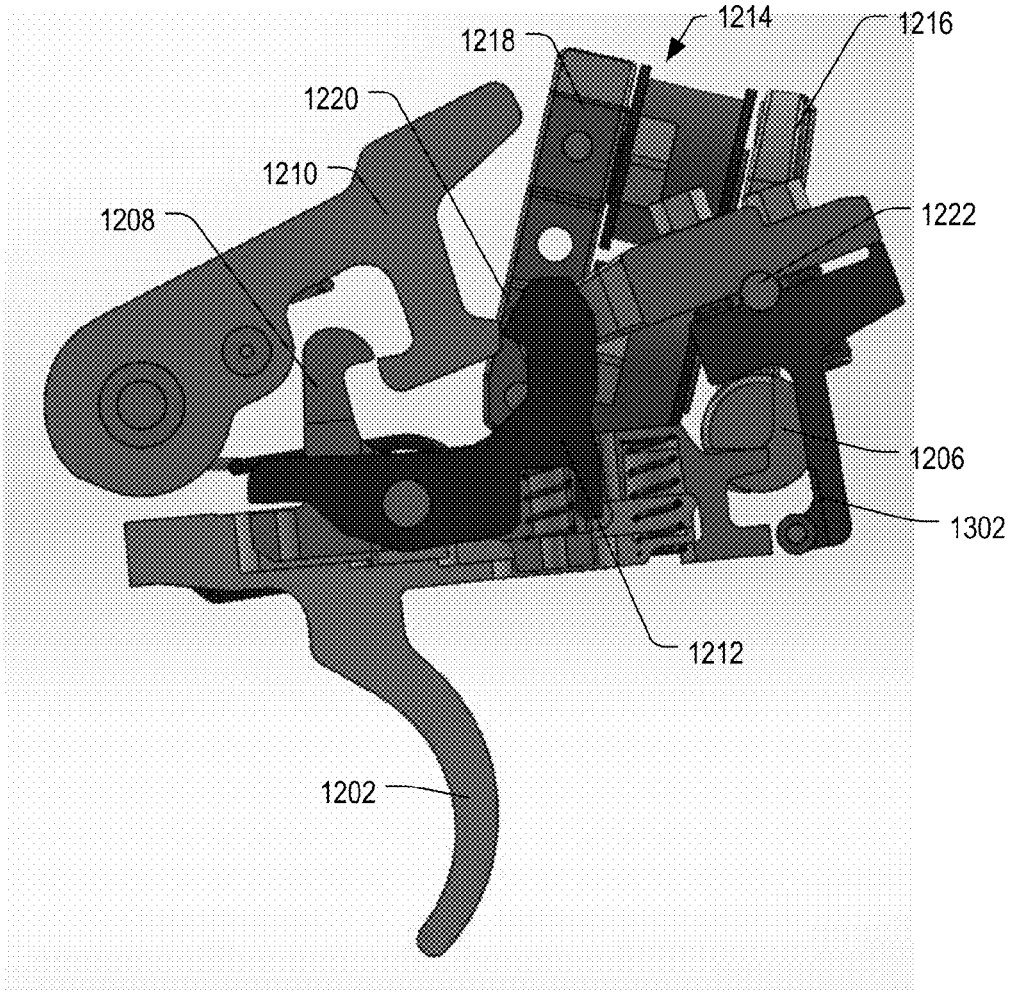
FIG. 15 is a side view of the trigger assembly of FIGS. 12A and 12B in a "just unblocked" state with the trigger pulled, the safety off, and the hammer released, according to certain embodiments.

FIG. 15 is a side view of the trigger assembly 1200 of FIGS. 12A and 12B, generally indicated at 1500. The trigger assembly 1500 is in a "just unblocked" state with the trigger shoe 1202 pulled, the safety off (represented by the orientation of the safety cam 1206), and the hammer 1210 released, according to certain embodiments. In the illustrated example, the actuator circuit 1214 has altered a rotational position of the switching portion 1216, moving the blocking lever 1302 out of contact with the main sear 1208. Since the blocking lever 1302 has moved out of contact with the main sear 1208, the force applied to the trigger shoe 1202 has been transferred by the spring to the main sear 1208 and the main sear 1208 has disengaged the hammer 1210.

Figure 16:
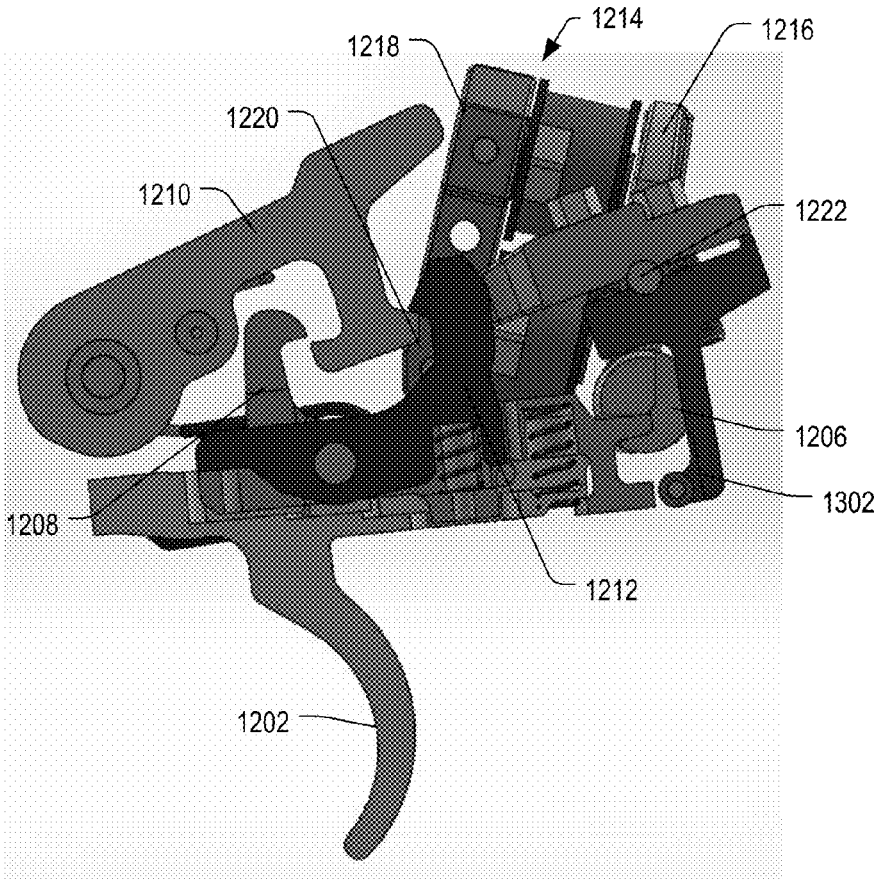
FIG. 16 is a side view of the trigger assembly of FIGS. 12A and 12B in an unblocked state immediately after ejection of the spent shell and load of a new bullet with the trigger still pulled, according to certain embodiments.

FIG. 16 is a side view of the trigger assembly 1200 of FIGS. 12A and 12B, generally indicated at 1600. The trigger assembly 1600 is in an unblocked state immediately after ejection of the spent shell and during or after loading of a new bullet while the trigger shoe 1202 is still pulled, according to certain embodiments. In the illustrated example, the safety cam 1206 is rotated into a safety off position, and the blocking lever 1302 is moved out of engagement with the main sear 1208. After the hammer 1210 swings forward to strike the firing pin (not shown) and discharge the projectile, the hammer 1210 swings back and is caught by the disconnect mechanism 1212 to facilitate readying of the firearm for a next firing event. Once the shooter releases the trigger shoe 1202, the main sear 1208 will rotate into engagement with the hammer 1210 and the disconnect mechanism 1212 releases the hammer 1210.

Figure 17:
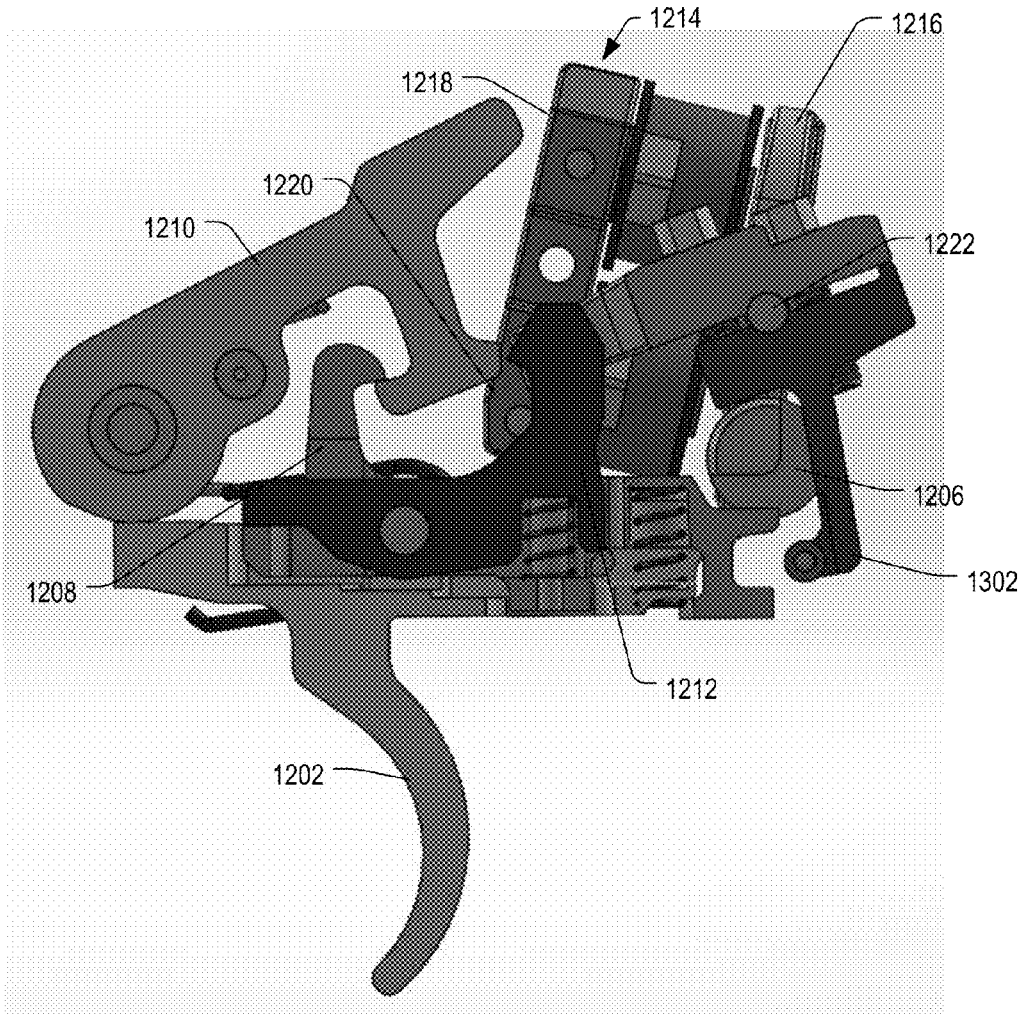
FIG. 17 is a side view of the trigger assembly of FIGS. 12A and 12B in a free fire mode according to certain embodiments.

FIG. 17 is a side view of the trigger assembly 1200 of FIGS. 12A and 12B, generally indicated at 1700. The trigger assembly 1700 is depicted in an unimpeded firing mode according to certain embodiments. In the unimpeded firing mode, the safety cam 1206 is rotated into a safety off position, and the blocking lever 1302 is moved into an non-blocking position, allowing a pull of the trigger shoe 1202 to move the main sear 1208 to release the hammer 1210 and discharge the firearm. In certain embodiments, the unimpeded firing mode may be accessed by the shooter by interacting with one or more user-selectable elements (such as buttons) on the trigger assembly, on the firearm, on a firearm scope, or any combination thereof. In certain embodiments, a control circuit of the firearm scope may control the blocked and unblocked state of the firearm by controlling the actuator circuit 1214 to shift the switching element 1216 to control timing of discharge of the firearm. In the unimpeded firing mode, the control circuit may enable conventional firing as opposed to assisted shooting as in a precision guided firearm.

Figure 18A:
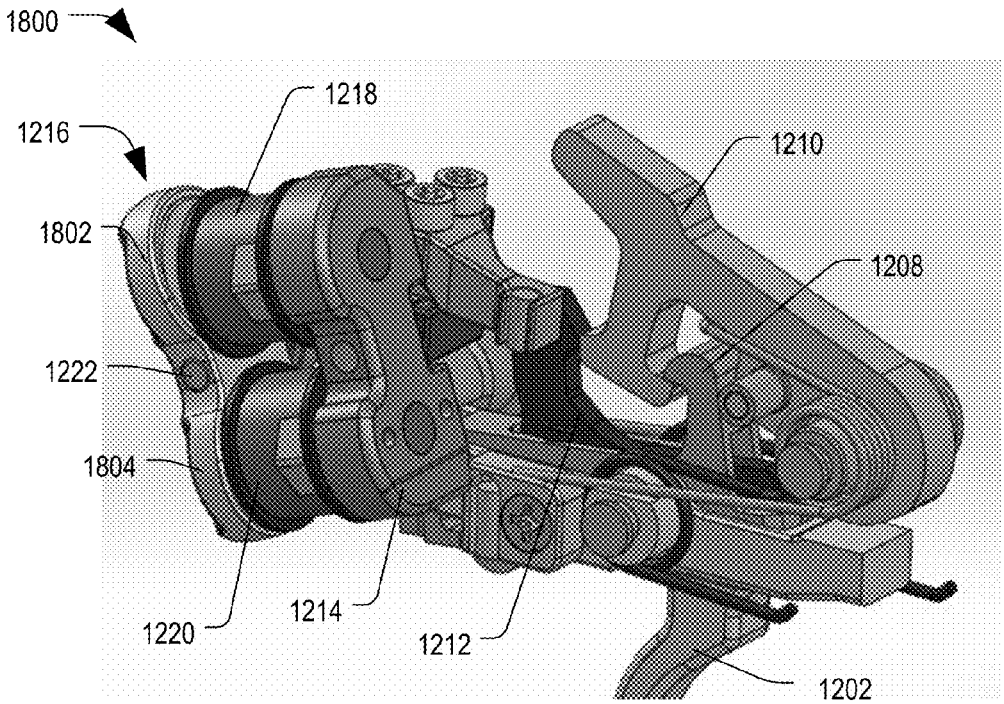
FIGS. 18A and 18B are perspective views of a trigger assembly including a bi-stable switch according to certain embodiments.
Figure 18B:
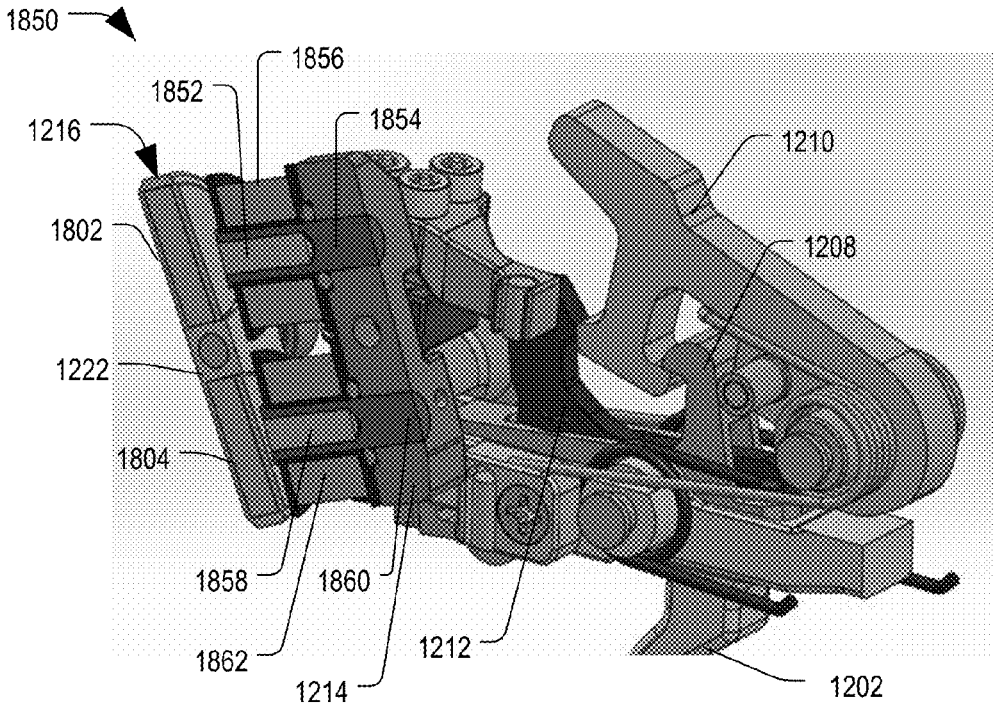

FIGS. 18A and 18B are perspective views of a trigger assembly including a bi-stable switch according to certain embodiments. In FIG. 18A, a perspective view of a trigger assembly 18A is shown and generally indicated at 1800. The trigger assembly 1800 includes a trigger shoe 1202, which engages a trigger sear 1208 to release a hammer 1210 to swing forward (left to right in FIG. 18A) to discharge a firearm. After discharge, the hammer 1210 may swing back (right to left) and may be caught by a disconnect mechanism 1212.

The trigger assembly 1800 may include an actuator circuit 1214 configured to selectively move a switching element 1216 about an axis 1222. In certain embodiments, the actuator circuit 1214 may include a first actuator element 1218, which may be proximate to a permanent magnet 1802 of the switching element 1216. The actuator circuit 1214 may include a second actuator element 1220, which may be proximate to a permanent magnet 1804 of the switching element 1216. As previously discussed with respect to FIGS. 3, 4, and 5A-5C, the actuator elements 1218 and 1220 may include a permanent magnet on an end proximate to the permanent magnets 1802 and 1804, respectively. Additionally, the actuator elements 1218 and 1220 may include an iron core and one or more conductive coils to which a current may be applied to selectively vary the magnetic field about the permanent magnets.

Referring now to FIG. 18B, the switching element 1216 is shown in partial cross-section, revealing the permanent magnets 1802 and 1804. Additionally, the actuator elements 1218 and 1220 of the actuator circuit 1214 are shown in partial cross-section. The actuator element 1218 includes a permanent magnet 1852 coupled to an iron core 1854, which is surrounded by a conductive coil 1856. The actuator element 1220 includes a permanent magnet 1858 coupled to an iron core 1860, which is surrounded by a conductive coil 1862.

The permanent magnets 1802 and 1852 are configured to attract one another, and the permanent magnets 1804 and 1858 are configured to attract one another. The magnetic fields of the permanent magnets 1802 and 1852 and the permanent magnets 1804 and 1858 are balanced such that once the state of the switching element 1216 is set, the permanent magnets (permanent magnets 1804 and 1858 in FIG. 18) are sufficiently strong to hold the state of the switching element 1216 when power is removed and even in response to a shock event, such as dropping of the firearm.

To switch the state of the switching element 1216, the actuator circuit 1214 may apply a current to the coil 1856, to the coil 1862, or to both coils to imbalance the magnetic fields. In certain embodiments, a current may be applied to the coil 1856 to augment the magnetic field of the permanent magnet 1852 to overcome the force of attraction between the permanent magnets 1804 and 1858 to switch the state of the switching element 1216. In certain embodiments, in addition to the current applied to the coil 1856 or in the alternative, a second current may be applied to the coil 1862 to offset the magnetic field of the permanent magnet 1858 by providing an opposing magnetic field, which pushes the switching element 1216 into a different state. Once the desired state of the switching element 1216 is achieved, the applied current(s) may be discontinued, and the permanent magnets 1802 and 1852 may hold the state of the switching element 1216 until a next switching event.

The processes, apparatuses, and devices (and improvements thereof) described herein are particularly useful improvements for trigger assemblies having electronic components, and particularly for firearms having electronic triggers, smart guns that control timing of discharge of a firearm, and trigger assemblies that include an electronically controlled safety or discharge mechanism. Further, the embodiments and examples herein provide improvements in the technology of trigger assemblies for precision guided firearms. In addition, embodiments and examples herein provide improvements to the functioning of a trigger assembly of a precision guided firearm by maintaining a state of a blocking mechanism with or without application of a voltage, thereby allowing the trigger assembly to maintain its state even if power is removed. While technical fields, descriptions, improvements, and advantages are discussed herein, these are not exhaustive and the embodiments and examples provided herein can apply to other technical fields, can provide further technical advantages, can provide for improvements to other technologies, and can provide other benefits to technology. Further, each of the embodiments and examples may include any one or more improvements, benefits and advantages presented herein.

The illustrations, examples, and embodiments described herein are intended to provide a general understanding of the structure of various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Further, structural and functional elements within the diagram may be combined, in certain embodiments, without departing from the scope of the disclosure. Additionally, structural and functional elements within one diagram may be combined, in certain embodiments, with structural elements, functional elements, or both from another diagram, without departing from the scope of the disclosure. Moreover, although specific embodiments have been illustrated and described herein, it should be appreciated that any subsequent arrangement designed to achieve the same or similar purposes may be substituted for the specific embodiments shown.

This disclosure is intended to cover any and all subsequent adaptations or variations of various embodiments. Combinations of the examples, and other embodiments not specifically described herein, will be apparent to those of skill in the art upon reviewing the description. Additionally, the illustrations are merely representational and may not be drawn to scale. Certain proportions within the illustrations may be exaggerated, while other proportions may be reduced. Accordingly, the disclosure and the figures are to be regarded as illustrative and not restrictive.

What is claimed is:

1. A trigger assembly configured for a firearm comprising:

a hammer including a sear location and including a catch location opposite to the sear location;

a sear configured to selectively engage the hammer at the sear location in a first state;

a bi-stable switch system configured to selectively engage a portion of the sear in the first state and to transition from the first state to a second state to selectively disengage the portion of the sear in response to an electrical signal, the bi-stable switch system including a rotatable switch element including a first end having a first permanent magnet and a second end having a second permanent magnet, the rotatable switch element including a pivot axis; and a disconnect mechanism configured to engage the hammer at the catch location after discharge of the firearm and to hold the hammer during a reset of the trigger assembly.

2. The trigger assembly of claim 1, wherein the bi-stable switch system is configured to maintain a state when power is removed.

3. The trigger assembly of claim 1, wherein the bi-stable switch system comprises an actuator configured to apply magnetic fields to the rotatable switch element to selectively move the rotatable switch element about the pivot axis.

4. The trigger assembly of claim 3, wherein the actuator comprises:

a first electromagnet;

the first permanent magnet coupled to a distal end of the first electromagnet;

a second electromagnet; and the second permanent magnet coupled to a distal end of the second electromagnet;

wherein an electrical signal is applied to at least one of the first electromagnet and the second electromagnet to alter a strength of a magnetic field proximate to at least one of the first permanent magnet and the second permanent magnet to move the rotatable switch element about the pivot axis.

5. The trigger assembly of claim 1, wherein the bi-stable switch system includes a blocking lever having a roller element configured to contact the portion of the sear.

6. The trigger assembly of claim 1, wherein the bi-stable switch system comprises:

an actuator circuit including:

a first electromagnet having a central lumen sized to receive a plunger;

the first permanent magnet within the central lumen of the first electromagnet;

a second electromagnet having a central lumen sized to receive a plunger;

the second permanent magnet within the central lumen of the second electromagnet;

a first plunger including a permanent magnet and positioned within the central lumen of the first electromagnet;

a second plunger including a permanent magnet and positioned within the central lumen of the second electromagnet;

an actuator linkage coupled to the first plunger and the second plunger; and a blocking lever coupled to the actuator linkage and configured to selectively engage the portion of the sear.

7. The trigger assembly of claim 1, wherein the bi-stable switch system further comprises:

an actuator circuit configured to selectively move a switching element; and a blocking lever configured to move in response to movement of the switching element, the blocking lever configured to selectively engage a portion of the sear in a first state and to transition from the first state to a second state to selectively disengage the portion of the sear in response to movement of the switching element.

8. The trigger assembly of claim 7, wherein the blocking lever includes a roller element configured to engage the portion of the sear.

9. The trigger assembly of claim 7, further comprising a first actuator coupled to the first blocking lever and adapted to move the first blocking lever into engagement with the first portion in a first state and to move the first blocking lever out of engagement with the first portion in a second state.

10. The trigger assembly of claim 9, wherein the first actuator comprises:

an electromagnet having a first end and a second end; and a bi-stable switch adapted to rotate about an axis in response to a current applied to the electromagnet.

11. The trigger assembly of claim 10, wherein the bi-stable switch comprises:

a body portion having a pivot element defining the axis;

a first arm extending from the body, the first arm adjacent to the first end of the electromagnet and having a first permanent magnet having a first polarity; and a second arm extending from the body and spaced part from the first arm, the second arm adjacent to the second end of the electromagnet and having a permanent magnet having a second polarity.

12. The trigger assembly of claim 10, wherein the electromagnet further comprises:

the first permanent magnet coupled to the first end of the electromagnet and having the second polarity; and the second permanent magnet coupled to the second end of the electromagnet and having the first polarity.

13. The trigger assembly of claim 9, further comprising:

a hook configured to engage the sear at a second location; and a second actuator configured to selectively move the hook into and out of engagement with the second location of the sear.

14. The trigger assembly of claim 9, further comprising:

a trigger shoe configured to engage the sear in response to a trigger pull, the trigger shoe including a recess; and a moveable lever including a first portion configured to move into the recess to engage the trigger shoe when moved in a first direction and a second portion to engage a portion of a trigger guard when moved in a second direction, the moveable lever configured to communicate with a circuit of the trigger assembly to access one or more functions of a firearm scope coupled to the circuit.

15. The trigger assembly of claim 7, wherein the bi-stable switch system and the blocking lever are configured to maintain a state when power is removed.

* * * * *